US008522897B2

(12) United States Patent
Hall et al.

(10) Patent No.: US 8,522,897 B2
(45) **Date of Patent: *Sep. 3, 2013**

(54) LEAD THE BIT ROTARY STEERABLE TOOL

(75) Inventors: David R. Hall, Provo, UT (US); Paula Turner, Pleasant Grove, UT (US); David Lundgreen, Provo, UT (US); Scott Woolston, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 382 days.

This patent is subject to a terminal disclaimer.

(21) Appl. No.: 12/557,679

(22) Filed: Sep. 11, 2009

(65) Prior Publication Data

US 2010/0000794 A1 Jan. 7, 2010

Related U.S. Application Data

(63) Continuation-in-part of application No. 12/362,661, filed on Jan. 30, 2009, which is a continuation-in-part of application No. 11/837,321, filed on Aug. 10, 2007, now Pat. No. 7,559,379, which is a continuation-in-part of application No. 11/750,700, filed on May 18, 2007, now Pat. No. 7,549,489, which is a continuation-in-part of application No. 11/737,034, filed on Apr. 18, 2007, now Pat. No. 7,503,405, which is a continuation-in-part of application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, now Pat. No. 7,600,586, which is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, which is a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196.

(51) Int. Cl.
*E21B 7/04* (2006.01)

(52) U.S. Cl.
USPC ..... 175/61; 175/73

(58) Field of Classification Search
USPC ..... 175/61, 73
See application file for complete search history.

(56) References Cited

U.S. PATENT DOCUMENTS 465,103 A 12/1891 Wegner
572,735 A 12/1896 Thompson (Continued)

OTHER PUBLICATIONS

PCT/US07/64544, International Preliminary Report on Patentability, Written Opinion, and International Search Report, Aug. 5, 2008.

(Continued)

*Primary Examiner* — Nicole Coy
(74) *Attorney, Agent, or Firm* — Brinks Hofer Gilson & Lione

(57) ABSTRACT

A drilling assembly comprises a drill bit that includes a bit body intermediate a working face and a shank. An indenting member adapted to guide the drill bit protrudes from the working face. A flexible portion is disposed above the bit body.

17 Claims, 17 Drawing Sheets

(56) References Cited

U.S. PATENT DOCUMENTS

| | | | |
|---|---|---|---|
| 590,113 | A | 9/1897 | Prindle |
| 616,118 | A | 12/1898 | Kunhe |
| 923,513 | A | 6/1909 | Hardsocg |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,258,418 | A | 3/1918 | Kemble |
| 1,360,908 | A | 11/1920 | Everson |
| 1,372,257 | A | 3/1921 | Swisher |
| 1,387,733 | A | 8/1921 | Midgett |
| 1,460,671 | A | 7/1923 | Hebsacker |
| 1,544,757 | A | 7/1925 | Hufford |
| 1,619,328 | A | 3/1927 | Benckenstein |
| 1,712,948 | A | 5/1929 | Burch |
| 1,746,455 | A | 2/1930 | Woodruff et al. |
| 1,746,456 | A | 2/1930 | Allington |
| 1,821,474 | A | 9/1931 | Mercer |
| 1,836,638 | A | 12/1931 | Wright et al. |
| 1,879,177 | A | 9/1932 | Gault |
| 1,921,135 | A | 8/1933 | Santiago |
| 2,022,101 | A | 11/1935 | Wright |
| 2,054,255 | A | 9/1936 | Howard |
| 2,064,255 | A | 12/1936 | Garfield |
| 2,100,692 | A | 11/1937 | Harmon |
| 2,102,236 | A | 12/1937 | Johansen |
| 2,121,202 | A | 6/1938 | Killgore |
| 2,153,034 | A | 4/1939 | Baker |
| 2,169,223 | A | 8/1939 | Christian |
| 2,170,452 | A | 8/1939 | Grant |
| 2,196,657 | A | 4/1940 | Burt |
| 2,196,940 | A | 4/1940 | Potts |
| 2,199,692 | A | 5/1940 | Catland |
| 2,216,130 | A | 10/1940 | Court |
| 2,218,130 | A | 10/1940 | Court |
| 2,227,233 | A | 12/1940 | Scott/Noble et al. |
| 2,249,769 | A | 7/1941 | Leonardon |
| 2,300,016 | A | 10/1942 | Scott et al. |
| 2,320,136 | A | 5/1943 | Kammerer |
| 2,320,670 | A | 6/1943 | Scaramucci |
| 2,345,024 | A | 3/1944 | Bannister |
| 2,371,248 | A | 3/1945 | McNamara |
| 2,375,335 | A | 5/1945 | Walker |
| 2,414,719 | A | 1/1947 | Cloud |
| 2,427,052 | A | 9/1947 | Grant |
| 2,466,991 | A | 4/1949 | Kammerer |
| 2,498,192 | A | 2/1950 | Wright |
| 2,540,464 | A | 2/1951 | Stokes |
| 2,544,336 | A | 3/1951 | Kammerer |
| 2,545,036 | A | 3/1951 | Kammerer |
| 2,575,173 | A | 11/1951 | Johnson |
| 2,578,593 | A | 12/1951 | Phipps |
| 2,615,519 | A | 10/1952 | Carr |
| 2,619,325 | A | 11/1952 | Arutunoff |
| 2,626,780 | A | 1/1953 | Ortloff |
| 2,643,860 | A | 6/1953 | Koch |
| 2,725,215 | A | 11/1955 | MacNeir |
| 2,735,653 | A | 2/1956 | Bielstein |
| 2,737,244 | A | 3/1956 | Baker et al. |
| 2,746,721 | A | 5/1956 | Moore |
| 2,755,071 | A | 7/1956 | Kammerer |
| 2,776,819 | A | 1/1957 | Brown |
| 2,807,443 | A | 9/1957 | Wyman |
| 2,815,932 | A | 12/1957 | Wolfram |
| 2,819,041 | A | 1/1958 | Beckham |
| 2,819,043 | A | 1/1958 | Henderson |
| 2,838,284 | A | 6/1958 | Austin |
| 2,868,511 | A | 1/1959 | Barrett |
| 2,873,093 | A | 2/1959 | Hildebrandt |
| 2,877,984 | A | 3/1959 | Causey |
| 2,894,722 | A | 7/1959 | Buttolph |
| 2,901,223 | A | 8/1959 | Scott |
| 2,917,704 | A | 12/1959 | Arps |
| 2,940,039 | A | 6/1960 | Yost et al. |
| 2,942,850 | A | 6/1960 | Heath |
| 2,942,851 | A | 6/1960 | Beck |
| 2,963,102 | A | 12/1960 | Smith |
| 2,998,085 | A | 8/1961 | Dulaney |
| 3,001,584 | A | 9/1961 | Scott |
| 3,036,645 | A | 5/1962 | Rowley |
| 3,039,531 | A | 6/1962 | Scott |
| 3,054,415 | A | 9/1962 | Baker et al. |
| 3,055,443 | A | 9/1962 | Edwards |
| 3,058,532 | A | 10/1962 | Alder |
| 3,059,708 | A | 10/1962 | Cannon et al. |
| 3,075,592 | A | 1/1963 | Overly et al. |
| 3,077,936 | A | 2/1963 | Arutunoff |
| 3,105,560 | A | 10/1963 | Zublin |
| 3,126,065 | A | 3/1964 | Chadderdon |
| 3,130,783 | A | 4/1964 | Orr |
| 3,135,341 | A | 6/1964 | Ritter |
| 3,139,147 | A | 6/1964 | Hays et al. |
| 3,163,243 | A | 12/1964 | Cleary |
| 3,187,191 | A | 6/1965 | Baggs |
| 3,199,617 | A | 8/1965 | White |
| 3,216,514 | A | 11/1965 | Nelson |
| 3,251,424 | A | 5/1966 | Brooks |
| 3,274,798 | A | 9/1966 | Wiggins, Jr. |
| 3,294,186 | A | 12/1966 | Buell |
| 3,301,339 | A | 1/1967 | Pennebaker, Jr. |
| 3,303,899 | A | 2/1967 | Jones, Jr. et al. |
| 3,319,147 | A | 5/1967 | Hays et al. |
| 3,336,988 | A | 8/1967 | Jones, Jr. |
| 3,342,267 | A | 9/1967 | Cotter et al. |
| 3,346,060 | A | 10/1967 | Beyer |
| 3,362,488 | A | 1/1968 | Loanesyan et al. |
| 3,379,264 | A | 4/1968 | Cox |
| 3,387,673 | A | 6/1968 | Thompson |
| 3,403,729 | A | 10/1968 | Hickey |
| 3,429,390 | A | 2/1969 | Bennett |
| 3,433,331 | A | 3/1969 | Heyberger |
| 3,455,158 | A | 7/1969 | Richter, Jr. et al. |
| 3,493,165 | A | 2/1970 | Schonfeld |
| 3,583,504 | A | 6/1971 | Aaulund |
| 3,635,296 | A | 1/1972 | Lebourg |
| 3,667,556 | A | 6/1972 | Henderson |
| 3,688,852 | A | 9/1972 | Gaylord |
| 3,700,049 | A | 10/1972 | Tiraspolsky et al. |
| 3,703,104 | A | 11/1972 | Tamplen |
| 3,732,143 | A | 5/1973 | Joosse |
| 3,758,731 | A | 9/1973 | Vann et al. |
| 3,765,493 | A | 10/1973 | Rosar et al. |
| 3,807,512 | A | 4/1974 | Pogonowski et al. |
| 3,815,692 | A | 6/1974 | Varley |
| 3,821,993 | A | 7/1974 | Kniff |
| 3,823,773 | A | 7/1974 | Nutter |
| 3,867,655 | A | 2/1975 | Stengel et al. |
| 3,885,638 | A | 5/1975 | Skidmore |
| 3,899,033 | A | 8/1975 | Van Huisen |
| 3,936,683 | A | 2/1976 | Walker |
| 3,955,535 | A | 5/1976 | Stock |
| 3,955,635 | A | 5/1976 | Skidmore |
| 3,960,223 | A | 6/1976 | Kleine |
| 3,967,201 | A | 6/1976 | Rorden |
| 3,971,450 | A | 7/1976 | Fox |
| 3,978,931 | A | 9/1976 | Sudnishnikov et al. |
| 3,986,554 | A | 10/1976 | Nutter |
| 3,989,114 | A | 11/1976 | Tschirky |
| 4,015,234 | A | 3/1977 | Krebs |
| 4,033,408 | A | 7/1977 | Fredd et al. |
| 4,081,042 | A | 3/1978 | Johnson |
| 4,096,917 | A | 6/1978 | Harris |
| 4,106,577 | A | 8/1978 | Summers |
| 4,109,737 | A | 8/1978 | Bovenkerk |
| 4,132,243 | A | 1/1979 | Kuus |
| RE30,055 | E | 7/1979 | Claycomb |
| 4,165,790 | A | 8/1979 | Emmerich |
| 4,173,457 | A | 11/1979 | Smith |
| 4,176,723 | A | 12/1979 | Arceneaux |
| 4,186,628 | A | 2/1980 | Bonnice |
| 4,207,485 | A | 6/1980 | Silver |
| 4,207,964 | A | 6/1980 | Taguchi |
| 4,211,291 | A | 7/1980 | Kellner |
| 4,253,533 | A | 3/1981 | Baker |

4,262,758 A * 4/1981 Evans ..... 175/73
4,266,605 A 5/1981 LaBorde et al.
4,277,707 A 7/1981 Silver et al.
4,280,573 A 7/1981 Sudnishnikov
4,283,779 A 8/1981 Lamel
4,304,312 A 12/1981 Larsson
4,307,786 A 12/1981 Evans
4,386,669 A 6/1983 Evans
4,397,361 A 8/1983 Langford
4,416,339 A 11/1983 Baker et al.
4,416,494 A 11/1983 Watkins et al.
4,445,580 A 5/1984 Sahley
4,448,269 A 5/1984 Ishikawa
4,462,469 A 7/1984 Brown
4,478,295 A 10/1984 Evans
4,478,296 A 10/1984 Richman, Jr.
4,491,187 A 1/1985 Russell
4,491,738 A 1/1985 Kamp
4,499,795 A 2/1985 Radtke
4,520,870 A 6/1985 Pringle
4,531,592 A 7/1985 Hayatdavoudi
4,532,614 A 7/1985 Peppers
4,533,004 A 8/1985 Ecer
4,535,853 A 8/1985 Ippolito
4,538,691 A 9/1985 Dennis
4,564,068 A 1/1986 Baugh
4,566,545 A 1/1986 Story
4,574,894 A 3/1986 Jadwin
4,574,895 A 3/1986 Dolezal
4,578,675 A 3/1986 MacLeod
4,583,592 A 4/1986 Gazda et al.
4,592,432 A 6/1986 Williams et al.
4,596,293 A 6/1986 Wallussek et al.
4,597,454 A 7/1986 Schoeffler
4,612,987 A 9/1986 Cheek
4,615,399 A 10/1986 Schoeffler
4,624,306 A 11/1986 Traver et al.
4,632,193 A 12/1986 Geczy
4,637,479 A 1/1987 Leising
4,640,374 A 2/1987 Dennis
4,655,289 A 4/1987 Schoeffler
4,676,310 A 6/1987 Scherbatskoy et al.
4,679,637 A 7/1987 Cherrington
4,683,781 A 8/1987 Kar et al.
4,694,913 A 9/1987 McDonald
4,720,640 A 1/1988 Anderson et al.
4,721,172 A 1/1988 Brett et al.
4,722,661 A 2/1988 Mizuno
4,729,441 A 3/1988 Peetz et al.
4,732,223 A 3/1988 Schoeffler
4,732,225 A 3/1988 Jurgens et al.
4,732,226 A 3/1988 Ebeling
4,733,734 A 3/1988 Bardin et al.
4,754,181 A 6/1988 Mizobuchi et al.
4,765,419 A 8/1988 Scholz et al.
4,775,017 A 10/1988 Forrest et al.
4,782,894 A 11/1988 LaFleur
4,785,247 A 11/1988 Meador et al.
4,788,544 A 11/1988 Howard
4,802,150 A 1/1989 Russell et al.
4,806,928 A 2/1989 Veneruso
4,817,739 A 4/1989 Jeter
4,819,745 A 4/1989 Walter
4,821,819 A 4/1989 Whysong
4,830,122 A 5/1989 Walter
4,836,301 A 6/1989 Van Dongen et al.
4,852,672 A 8/1989 Behrens
4,858,706 A 8/1989 Lebourgh
4,869,100 A 9/1989 Birdwell
4,875,531 A 10/1989 Biehl et al.
4,889,017 A 12/1989 Fuller
4,889,199 A 12/1989 Lee
4,893,678 A 1/1990 Stokley et al.
4,895,214 A 1/1990 Schoeffler
4,899,835 A 2/1990 Cherrington
4,907,665 A 3/1990 Kar et al.
4,924,499 A 5/1990 Serby
4,924,949 A 5/1990 Curlett
4,928,520 A 5/1990 Barrington
4,938,297 A 7/1990 Schmidt
4,962,822 A 10/1990 Pascale
4,965,998 A 10/1990 Estigoy et al.
4,974,688 A 12/1990 Helton
4,979,577 A 12/1990 Walter
4,981,184 A 1/1991 Knowlton
4,991,667 A 2/1991 Wilkes et al.
4,991,670 A 2/1991 Fuller
5,009,273 A 4/1991 Grabinski
5,027,914 A 7/1991 Wilson
5,038,873 A 8/1991 Jurgens
5,052,503 A 10/1991 Lof
5,088,568 A 2/1992 Simuni
5,090,944 A 2/1992 Kyo et al.
5,094,304 A 3/1992 Briggs
5,098,258 A 3/1992 Barnetche-Gonzalez
5,099,927 A 3/1992 Gibson et al.
5,103,919 A 4/1992 Warren et al.
5,112,188 A 5/1992 Barnetche-Gonzalez
5,119,892 A 6/1992 Clegg
5,135,060 A 8/1992 Ide
5,141,063 A 8/1992 Quesenbury
5,148,875 A 9/1992 Karlsson et al.
5,163,520 A 11/1992 Gibson et al.
5,176,212 A 1/1993 Tandberg
5,186,268 A 2/1993 Clegg
5,189,645 A 2/1993 Innes
5,193,628 A 3/1993 Hill, III et al.
5,222,566 A 6/1993 Taylor
5,230,390 A 7/1993 Zastresek et al.
5,232,058 A 8/1993 Morin et al.
5,248,896 A 9/1993 Forrest
5,255,749 A 10/1993 Bumpurs
5,259,469 A 11/1993 Stjernstrom
5,265,682 A 11/1993 Russell
5,270,600 A 12/1993 Hashimoto
5,311,953 A 5/1994 Walker
5,314,030 A 5/1994 Peterson et al.
5,316,094 A 5/1994 Pringle
5,332,051 A 7/1994 Knowlton
5,337,002 A 8/1994 Mercer
5,339,037 A 8/1994 Bonner et al.
5,361,859 A 11/1994 Tibbitts
5,388,649 A 2/1995 Ilomaki
5,392,862 A 2/1995 Swearingen
5,410,303 A 4/1995 Comeau
5,415,030 A 5/1995 Jogi et al.
5,417,292 A 5/1995 Polakoff
5,423,389 A 6/1995 Warren
5,442,294 A 8/1995 Rorden
5,443,128 A 8/1995 du Chaffaut
5,475,309 A 12/1995 Hong et al.
5,499,687 A 3/1996 Lee
5,507,357 A 4/1996 Hult
5,517,464 A 5/1996 Lerner et al.
5,535,839 A 7/1996 Brady
5,539,225 A 7/1996 Loomis et al.
5,539,258 A 7/1996 Sutton et al.
5,547,032 A 8/1996 Wenzel
5,553,678 A 9/1996 Barr et al.
5,560,440 A 10/1996 Tibbitts
5,568,838 A 10/1996 Struthers
5,584,342 A 12/1996 Swinford
5,609,178 A 3/1997 Hennig et al.
5,626,200 A 5/1997 Gilbert et al.
5,642,782 A 7/1997 Grimshaw
5,655,614 A 8/1997 Azar
5,673,763 A 10/1997 Thorp
5,678,644 A 10/1997 Fielder
5,685,379 A 11/1997 Barr et al.
5,695,015 A 12/1997 Barr et al.
5,706,905 A 1/1998 Barr
5,720,355 A 2/1998 Lamine et al.
5,728,420 A 3/1998 Keogh
5,730,222 A 3/1998 Rike, Jr.
5,732,784 A 3/1998 Nelson
5,758,731 A 6/1998 Zollinger
5,758,732 A 6/1998 Liw
5,762,156 A 6/1998 Bates et al.

5,778,991 A 7/1998 Runquist et al.
5,794,728 A 8/1998 Palmberg
5,803,185 A 9/1998 Barr et al.
5,803,193 A 9/1998 Krueger et al.
5,806,611 A 9/1998 Van Den Steen
5,833,002 A 11/1998 Holcombe
5,833,021 A 11/1998 Mensa-Wilmot
5,839,508 A 11/1998 Tubel et al.
5,848,657 A 12/1998 Flood
5,856,790 A 1/1999 Baugh et al.
5,864,058 A 1/1999 Chen
5,896,938 A 4/1999 Money
5,901,113 A 5/1999 Masak
5,901,796 A 5/1999 McDonald
5,904,444 A 5/1999 Kabeuchi et al.
5,924,499 A 7/1999 Birchak et al.
5,947,215 A 9/1999 Lundell
5,950,743 A 9/1999 Cox
5,957,223 A 9/1999 Doster
5,957,225 A 9/1999 Sinor
5,965,964 A 10/1999 Skinner et al.
5,967,247 A 10/1999 Pessier
5,979,571 A 11/1999 Scott et al.
5,992,547 A 11/1999 Caraway
5,992,548 A 11/1999 Silva
6,003,623 A 12/1999 Miess
6,011,334 A 1/2000 Roland
6,021,589 A 2/2000 Cagliari et al.
6,030,004 A 2/2000 Schock et al.
6,039,131 A 3/2000 Beaton
6,047,239 A 4/2000 Berger et al.
6,050,350 A 4/2000 Morris et al.
6,057,784 A 5/2000 Schaaf et al.
6,089,332 A 7/2000 Barr et al.
6,092,610 A 7/2000 Kosmala et al.
6,123,561 A 9/2000 Turner et al.
6,131,675 A 10/2000 Anderson
6,142,250 A 11/2000 Griffin et al.
6,150,822 A 11/2000 Hong et al.
6,161,631 A 12/2000 Kennedy
6,186,251 B1 2/2001 Butcher
6,196,340 B1 3/2001 Jensen et al.
6,199,645 B1 3/2001 Anderson et al.
6,199,956 B1 3/2001 Kammerer
6,202,761 B1 3/2001 Forney
6,213,225 B1 4/2001 Chen
6,213,226 B1 4/2001 Eppink
6,220,079 B1 4/2001 Taylor et al.
6,223,824 B1 5/2001 Moyes
6,223,826 B1 5/2001 Chau et al.
6,253,847 B1 7/2001 Stephenson
6,253,864 B1 7/2001 Hall
6,269,893 B1 8/2001 Beaton
6,290,007 B2 9/2001 Beuershausen et al.
6,296,069 B1 10/2001 Lamine et al.
6,298,930 B1 10/2001 Sinor
6,321,858 B1 11/2001 Wentworth et al.
6,325,163 B2 12/2001 Tibbitts
6,332,503 B1 12/2001 Pessier
6,338,390 B1 1/2002 Tibbitts
6,340,064 B2 1/2002 Fielder
6,363,780 B1 4/2002 Rey-Fabret
6,364,034 B1 4/2002 Schoeffler
6,364,038 B1 4/2002 Driver
6,367,564 B1 4/2002 Mills et al.
6,382,330 B2 5/2002 Bischel et al.
6,388,346 B1 5/2002 Lopatinsky et al.
6,390,200 B1 5/2002 Allamon et al.
6,392,317 B1 5/2002 Hall et al.
6,394,200 B1 5/2002 Watson
6,408,959 B2 6/2002 Bertagnolli
6,419,014 B1 7/2002 Meek et al.
6,431,270 B1 8/2002 Angle
6,439,326 B1 8/2002 Huang et al.
6,443,249 B2 9/2002 Beuershausen
6,446,728 B2 9/2002 Chau et al.
6,450,269 B1 9/2002 Wentworth
6,454,030 B1 9/2002 Findley et al.
6,466,513 B1 10/2002 Pabon et al.
6,467,341 B1 10/2002 Boucher et al.
6,474,425 B1 11/2002 Truax
6,484,819 B1 11/2002 Harrison
6,484,825 B2 11/2002 Watson
6,484,826 B1 11/2002 Anderson
6,495,929 B2 12/2002 Bosley et al.
6,502,650 B1 1/2003 Beccu
6,510,906 B1 1/2003 Richert
6,513,606 B1 2/2003 Krueger
6,533,050 B2 3/2003 Molloy
6,550,534 B2 4/2003 Brett
6,561,289 B2 5/2003 Portman et al.
6,571,888 B2 6/2003 Comeau et al.
6,575,236 B1 6/2003 Heinjen
6,581,699 B1 6/2003 Chen et al.
6,588,518 B2 7/2003 Eddison
6,594,881 B2 7/2003 Tibbitts
6,601,454 B1 8/2003 Botnan
6,601,662 B2 8/2003 Matthias et al.
6,619,388 B2 9/2003 Dietz et al.
6,622,803 B2 9/2003 Harvey
6,634,388 B1 10/2003 Taylor et al.
6,651,755 B1 11/2003 Kelpe
6,652,202 B2 11/2003 Remke et al.
6,655,464 B2 12/2003 Chau et al.
6,668,949 B1 12/2003 Rives
6,670,880 B1 12/2003 Hall et al.
6,672,406 B2 1/2004 Beuershausen
6,672,409 B1 1/2004 Dock et al.
6,688,396 B2 2/2004 Floerke et al.
6,698,537 B2 3/2004 Pascale
6,717,283 B2 4/2004 Skinner et al.
6,717,501 B2 4/2004 Hall et al.
6,729,420 B2 5/2004 Mensa-Wilmot et al.
6,732,817 B2 5/2004 Dewey
6,739,413 B2 5/2004 Sharp et al.
6,745,844 B2 6/2004 Henderson
6,749,031 B2 6/2004 Klemm
6,776,240 B2 8/2004 Kenison et al.
6,789,635 B2 9/2004 Wentworth et al.
6,794,777 B1 9/2004 Fradella
6,799,632 B2 10/2004 Hall et al.
6,814,162 B2 11/2004 Moran et al.
6,820,697 B1 11/2004 Churchill
6,821,147 B1 11/2004 Hall et al.
6,822,579 B2 11/2004 Goswami
6,830,467 B2 12/2004 Hall et al.
6,844,498 B2 1/2005 Hall et al.
6,845,822 B2 1/2005 Chau
6,848,503 B2 2/2005 Schultz et al.
6,850,068 B2 2/2005 Chemali et al.
6,854,953 B2 2/2005 Van Drentham-Susman et al.
6,863,124 B2 3/2005 Araux et al.
6,880,648 B2 4/2005 Edscer
6,880,649 B2 4/2005 Edscer
6,888,473 B1 5/2005 Hall et al.
6,913,093 B2 7/2005 Hall et al.
6,913,095 B2 7/2005 Krueger
6,920,930 B2 7/2005 Allamon et al.
6,929,076 B2 8/2005 Fanuel et al.
6,929,493 B2 8/2005 Hall et al.
6,945,802 B2 9/2005 Hall et al.
6,948,572 B2 9/2005 Hay et al.
6,953,096 B2 10/2005 Gledhill
6,968,611 B2 11/2005 Hall et al.
6,994,175 B2 2/2006 Egerstrom
7,013,994 B2 3/2006 Eddison
7,025,155 B1 4/2006 Estes
7,028,779 B2 4/2006 Chau
7,036,611 B2 5/2006 Radford et al.
7,048,078 B2 5/2006 Dewey et al.
7,073,610 B2 7/2006 Susman
7,095,233 B1 8/2006 Tabanou et al.
7,096,980 B2 8/2006 Trevas
7,104,344 B2 9/2006 Kriesels et al.
7,133,325 B2 11/2006 Kotsonis et al.
7,150,329 B2 12/2006 Chau
7,165,608 B2 1/2007 Schultz et al.
7,190,084 B2 3/2007 Hall et al.

7,193,526 B2 3/2007 Hall et al.
7,198,119 B1 4/2007 Hall et al.
7,201,239 B1 4/2007 Perry
7,204,560 B2 4/2007 Mercier et al.
7,219,747 B2 5/2007 Gleitman et al.
7,225,886 B1 6/2007 Hall
7,240,744 B1 7/2007 Kemick
7,246,660 B2 7/2007 Fripp et al.
7,258,179 B2 8/2007 Hall
7,261,184 B2 8/2007 Bass et al.
7,270,196 B2 9/2007 Hall
7,308,937 B2 12/2007 Radford et al.
7,328,755 B2 2/2008 Hall et al.
7,331,397 B1 2/2008 Wagley et al.
7,337,858 B2 3/2008 Hall et al.
D566,137 S 4/2008 Hall et al.
7,360,610 B2 * 4/2008 Hall et al. ..... 175/61
7,360,612 B2 4/2008 Chen et al.
7,367,397 B2 5/2008 Clemens et al.
D572,735 S 7/2008 Kammerer
7,398,837 B2 7/2008 Hall et al.
7,419,016 B2 9/2008 Hall et al.
7,419,018 B2 9/2008 Hall
7,424,922 B2 9/2008 Hall et al.
7,426,968 B2 9/2008 Hall et al.
7,464,772 B2 12/2008 Hall et al.
7,481,281 B2 1/2009 Schuaf
7,484,576 B2 2/2009 Hall et al.
7,497,279 B2 3/2009 Hall et al.
7,503,405 B2 3/2009 Hall et al.
7,506,701 B2 * 3/2009 Hall et al. ..... 175/61
7,506,706 B2 3/2009 Hall et al.
7,510,031 B2 3/2009 Russell et al.
7,533,737 B2 5/2009 Hall
7,549,489 B2 6/2009 Hall et al.
7,559,379 B2 7/2009 Hall et al.
7,571,780 B2 8/2009 Hall et al.
7,571,782 B2 8/2009 Hall et al.
7,600,586 B2 10/2009 Hall et al.
7,617,886 B2 11/2009 Hall et al.
7,624,824 B2 12/2009 Hall et al.
7,637,323 B2 12/2009 Schasteen et al.
7,641,002 B2 1/2010 Hall et al.
7,641,003 B2 1/2010 Hall et al.
7,661,487 B2 2/2010 Hall
7,694,756 B2 4/2010 Hall et al.
7,730,975 B2 6/2010 Hall et al.
D620,510 S 7/2010 Hall
7,753,144 B2 7/2010 Hall et al.
2001/0004946 A1 6/2001 Jensen
2001/0007290 A1 7/2001 Saxman
2001/0031178 A1 10/2001 Remke
2001/0054515 A1 12/2001 Eddison et al.
2002/0050359 A1 5/2002 Eddison
2002/0079139 A1 6/2002 Mensa-Wilmot
2002/0079140 A1 6/2002 Eyre et al.
2002/0135179 A1 9/2002 Boyle et al.
2002/0162654 A1 11/2002 Bauer et al.
2002/0175555 A1 11/2002 Mercier
2003/0042812 A1 3/2003 Post
2003/0116969 A1 6/2003 Skinner et al.
2003/0192449 A1 10/2003 Fiske et al.
2003/0209366 A1 11/2003 McAlvain
2003/0213598 A1 11/2003 Hughes
2003/0213621 A1 11/2003 Britten
2004/0026132 A1 2/2004 Hall et al.
2004/0026983 A1 2/2004 McAlvain
2004/0065484 A1 4/2004 McAlvain
2004/0104797 A1 6/2004 Hall et al.
2004/0113808 A1 6/2004 Hall et al.
2004/0145492 A1 7/2004 Hall et al.
2004/0150532 A1 8/2004 Hall et al.
2004/0154839 A1 8/2004 McGarian et al.
2004/0164833 A1 8/2004 Hall et al.
2004/0164838 A1 8/2004 Hall et al.
2004/0173381 A1 9/2004 Moore et al.
2004/0182366 A1 9/2004 Andersson et al.
2004/0216847 A1 11/2004 Hall et al.
2004/0222024 A1 11/2004 Edscer
2004/0238165 A1 12/2004 Salamitou et al.
2004/0238221 A1 * 12/2004 Runia et al. ..... 175/61
2004/0244916 A1 12/2004 Hall et al.
2004/0244964 A1 12/2004 Hall et al.
2004/0246142 A1 12/2004 Hall et al.
2004/0256153 A1 12/2004 Helms et al.
2004/0256155 A1 12/2004 Kriesels
2005/0001735 A1 1/2005 Hall et al.
2005/0001736 A1 1/2005 Hall et al.
2005/0001738 A1 1/2005 Hall et al.
2005/0011678 A1 1/2005 Akinlade et al.
2005/0024231 A1 2/2005 Fincher et al.
2005/0035874 A1 2/2005 Hall et al.
2005/0035875 A1 2/2005 Hall et al.
2005/0035876 A1 2/2005 Hall et al.
2005/0036507 A1 2/2005 Hall et al.
2005/0039912 A1 2/2005 Hall et al.
2005/0045339 A1 3/2005 Hall et al.
2005/0046586 A1 3/2005 Hall et al.
2005/0046590 A1 3/2005 Hall et al.
2005/0067159 A1 3/2005 Hall et al.
2005/0070144 A1 3/2005 Hall et al.
2005/0072598 A1 4/2005 Fanuel et al.
2005/0082092 A1 4/2005 Hall et al.
2005/0082093 A1 4/2005 Keshavan et al.
2005/0092499 A1 5/2005 Hall et al.
2005/0093296 A1 5/2005 Hall et al.
2005/0095827 A1 5/2005 Hall et al.
2005/0115717 A1 6/2005 Hall et al.
2005/0115718 A1 6/2005 Symons et al.
2005/0139393 A1 6/2005 Maurer et al.
2005/0145406 A1 7/2005 Hall et al.
2005/0145417 A1 7/2005 Radford et al.
2005/0150653 A1 7/2005 Hall et al.
2005/0155450 A1 7/2005 Jennings
2005/0161215 A1 7/2005 Hall et al.
2005/0173128 A1 8/2005 Hall et al.
2005/0211471 A1 9/2005 Zupanick
2005/0212530 A1 9/2005 Hall et al.
2005/0236160 A1 10/2005 Hall et al.
2005/0284662 A1 12/2005 Hall et al.
2006/0033379 A1 2/2006 Frear
2006/0034154 A1 2/2006 Perry et al.
2006/0196699 A1 9/2006 Estes et al.
2006/0207802 A1 9/2006 Zhang et al.
2006/0243455 A1 11/2006 Telfer et al.
2006/0243493 A1 11/2006 El-Rayes et al.
2006/0260801 A1 11/2006 Hall et al.
2006/0283640 A1 12/2006 Estes et al.
2007/0017679 A1 1/2007 Wolf et al.
2007/0029116 A1 2/2007 Keshavan
2007/0056724 A1 3/2007 Spring et al.
2007/0062706 A1 3/2007 Leising
2007/0079988 A1 4/2007 Konschuh et al.
2007/0107944 A1 5/2007 Lee
2007/0114067 A1 5/2007 Hall
2007/0114068 A1 5/2007 Hall et al.
2007/0119630 A1 5/2007 Hall et al.
2007/0125580 A1 6/2007 Hall et al.
2007/0151732 A1 7/2007 Clemens et al.
2007/0194948 A1 8/2007 Hall et al.
2007/0205023 A1 9/2007 Hoffmaster et al.
2007/0221406 A1 9/2007 Hall et al.
2007/0221409 A1 9/2007 Hall et al.
2007/0221412 A1 9/2007 Hall et al.
2007/0221415 A1 9/2007 Hall et al.
2007/0221416 A1 9/2007 Hall et al.
2007/0221417 A1 9/2007 Hall et al.
2007/0229232 A1 10/2007 Hall et al.
2007/0229304 A1 10/2007 Hall et al.
2007/0242565 A1 10/2007 Hall et al.
2007/0251696 A1 11/2007 Parks
2007/0272448 A1 11/2007 Griffo
2007/0277651 A1 12/2007 Calnan
2008/0006448 A1 1/2008 Zhang
2008/0011521 A1 1/2008 Hall et al.
2008/0029312 A1 2/2008 Hall et al.
2008/0041597 A1 2/2008 Fisher et al.
2008/0073126 A1 3/2008 Shen et al.

| | | | |
|---|---|---|---|
| 2008/0099243 | A1 | 5/2008 | Hall et al. |
| 2008/0105464 | A1 | 5/2008 | Radford |
| 2008/0142264 | A1 | 6/2008 | Hall et al. |
| 2008/0142265 | A1 | 6/2008 | Hall et al. |
| 2008/0011522 | A1 | 7/2008 | Hall et al. |
| 2008/0173482 | A1 | 7/2008 | Hall et al. |
| 2008/0217024 | A1 | 9/2008 | Moore |
| 2008/0230278 | A9 | 9/2008 | Hoffmaster et al. |
| 2008/0296015 | A1 | 12/2008 | Hall et al. |
| 2008/0302572 | A1 | 12/2008 | Hall et al. |
| 2008/0314645 | A1 | 12/2008 | Hall et al. |
| 2009/0044951 | A1 | 2/2009 | Milkovisch et al. |
| 2009/0056497 | A1 | 3/2009 | Swinford |
| 2009/0126936 | A1 | 5/2009 | Begley et al. |
| 2009/0166086 | A1 | 7/2009 | Sugiura |
| 2009/0260894 | A1 | 10/2009 | Hall et al. |
| 2009/0260984 | A1 | 10/2009 | Hall |
| 2010/0000799 | A1 | 1/2010 | Hall et al. |
| 2010/0065334 | A1 | 3/2010 | Hall |
| 2010/0132954 | A1 | 6/2010 | Telfer |
| 2011/0120725 | A1 | 5/2011 | Downton et al. |
| 2011/0278017 | A1 | 11/2011 | Themig et al. |

OTHER PUBLICATIONS

PCT/US06/43107, International Preliminary Report on Patentability, International Search Report and Written Opinion of the International Searching Authority, Mar. 5, 2007.

PCT/US06/43125, International Preliminary Report on Patentability and Written Opinion of the International Searching Authority, Jun. 4, 2007, and the International Search Report, Feb. 23, 2007.

PCT/US07/64539, International Preliminary Report on Patentability, International Search Report and Written Opinion, Jun. 16, 2008.

Bonner, Steve, et al., "Measurements at the Bit: A New Generation of MWD Tools," Oilfield Review, pp. 44-54 (Apr./Jul. 1993).

Ocean Drilling Program (ODP) Logging Services, "Logging-While-Drilling Resistivity-at-Bit Tool," Lamont-Doherty Earth Observatory, Palisades, NY, 2 pages (Dec. 2003).

* cited by examiner

LEAD THE BIT ROTARY STEERABLE TOOL

CROSS REFERENCE TO RELATED APPLICATIONS

This Patent Application is a continuation-in-part of U.S. patent application Ser. No. 12/362,661 filed on Jan. 30, 2009, which is a continuation-in-part of U.S. patent application Ser. No. 11/837,321 filed on Aug. 10, 2007 and that issued as U.S. Pat. No. 7,559,379 on Jul. 14, 2009, which is a continuation-in-part of U.S. patent application Ser. No. 11/750,700 filed on May 18, 2007 and that issued as U.S. Pat. No. 7,549,489 on Jun. 23, 2009, which is a continuation-in-part of U.S. patent application Ser. No. 11/737,034 filed on Apr. 17, 2007 and that issued as U.S. Pat. No. 7,503,405 on Mar. 17, 2008, which is a continuation-in-part of U.S. patent application Ser. No. 11/686,638 filed on Mar. 15, 2007 and that issued as U.S. Pat. No. 7,424,922 on Sep. 16, 2008, which is a continuation-in-part of U.S. patent application Ser. No. 11/680,997 filed on Mar. 1, 2007 and that issued as U.S. Pat. No. 7,419,016 on Sep. 2, 2008, which is a continuation-in-part of U.S. patent application Ser. No. 11/673,872 filed on Feb. 12, 2007 and that issued as U.S. Pat. No. 7,484,576 on Feb. 3, 2009, which is a continuation-in-part of U.S. patent application Ser. No. 11/611,310 filed on Dec. 15, 2006 and that issued as U.S. Pat. No. 7,600,586 on Oct. 13, 2009. The U.S. patent application Ser. No. 11/837,321 is a continuation-in-part of U.S. patent application Ser. No. 11/278,935 filed on Apr. 6, 2006 and that issued as U.S. Pat. No. 7,426,968 on Sep. 23, 2008, which is a continuation-in-part of U.S. patent application Ser. No. 11/277,394 filed on Mar. 24, 2006 and that issued as U.S. Pat. No. 7,398,837 on Jul. 15, 2008, which is a continuation-in-part of U.S. patent application Ser. No. 11/277,380 filed on Mar. 24, 2006 and that issued as U.S. Pat. No. 7,337,858 on Mar. 4, 2008, which is a continuation-in-part of U.S. patent application Ser. No. 11/306,976 filed on Jan. 18, 2006 and that issued as U.S. Pat. No. 7,360,610 on Apr. 22, 2008, which is a continuation-in-part of U.S. patent application Ser. No. 11/306,307 filed Dec. 22, 2005 and that issued as U.S. Pat. No. 7,225,886 on Jun. 5, 2007, which is a continuation-in-part of U.S. patent application Ser. No. 11/306,022 filed on Dec. 14, 2005 and that issued as U.S. Pat. No. 7,198,119 on Apr. 3, 2007, which is a continuation-in-part of U.S. patent application Ser. No. 11/164,391 filed on Nov. 21, 2005 and that issued as U.S. Pat. No. 7,270,196 on Sep. 18, 2007. All of these applications are herein incorporated by reference in their entirety and their priorities claimed.

BACKGROUND OF THE INVENTION

This invention relates to the field of tools used in directional drilling. More specifically, the invention includes a flexible portion disposed in a drill string to facilitate drilling inclined wellbores. The prior art includes several methods for steering a tool string. An embodiment of a bent sub system is generally depicted in FIG. 1*a*. In this embodiment, a drill string 2000 comprises a bent sub 2050 above the drill bit 2051. A hydraulic motor housed within a bore of a drill string component rotates the drill bit 2051 below the bent sub 2050. As drilling mud is passed through the drill string 2000, the motor turns in response to the flow and rotates a portion 2052 of the drill string 2000 below the bent sub 2050. A portion 2053 of the drilling string 2000 above the bent sub 2050 does not rotate from the motor, but slides through the wellbore as the drill bit 2051 advances into the earth. The bent sub 2050 directs the trajectory of the drill string 2000 in relation to an angle of the bent sub 2050.

An embodiment of a push-the-bit system is generally depicted in FIG. 1*b*. In this embodiment of a drill string 2100, an extendable pad 2150 is located above the drill bit 2151. Typically, there is more than one extendable pad oriented around an outer surface of the drill string 2100 near the drill bit 2151 that are timed together so as to extend at the same azimuth with relation to the well bore while the drill string 2100 is rotating. Each time an extendable pad 2150 extends, it pushes the drill bit 2151 off course and may be used to control the trajectory of the drill string 2100.

Yet another embodiment for steering a bit includes point-the-bit systems where a drill bit is actively positioned from further up a drill string.

Variations of these systems are disclosed in the following prior art documents. U.S. Pat. No. 5,529,133 to Eddison, which is hereby incorporated by reference for all that it contains, discloses a steerable rotary drilling tool that includes a drill bit mounted on the lower end of a housing by a drive shaft having an articulative coupling that allows the bit's rotation axis to be inclined relative to the rotation axis of the housing, an eccentric weight in the housing that maintains the bit axis pointed in only one direction in space as the bit is turned by the housing, and a clutch system that allows such direction to be changed downhole. A measuring-while-drilling tool is included to allow the progress of the drilling to be monitored at the surface and to allow changing the bit axis or toolface by a selected amount.

U.S. Pat. No. 5,078,650 to Foote which is herein incorporated by reference for all that it contains discloses a universal joint arrangement that includes a first adapter having two projecting support formations; a drive plate having a first pair of matching depressions or pockets is seated with these depressions on the projecting support formations of the first adapter and the drive plate has a second pair of pockets for the projecting support formations of a respective second adapter.

U.S. Pat. No. 7,188,685 to Downton which is herein incorporated by reference for all that it contains discloses a bottom hole assembly that is rotatably adapted for drilling directional boreholes into an earthen formation. It has an upper stabilizer mounted to a collar, and a rotary steerable system. The rotary steerable system has an upper section connected to the collar, a steering section, and a drill bit arranged for drilling the borehole attached to the steering section. The steering section is joined at a swivel with the upper section. The steering section is actively tilted about the swivel. A lower stabilizer is mounted upon the steering section such that the swivel is intermediate the drill bit and the lower stabilizer.

BRIEF SUMMARY OF THE INVENTION

In one aspect of the present invention, a drilling assembly includes a drill bit body disposed intermediate a working face and a shank. The shank may be attached to a drill string. The working face comprises an indenting member protruding from the working face, the indenting member being adapted to guide the drill bit. A flexible portion is disposed above the bit body to allow angular deflection of the bit with respect to the drill string.

The flexible portion may comprise upper and lower segments, and may be disposed intermediate, or between, the bit body and the shank or may be disposed intermediate, or between, the shank and an adjacent drill string component. The lower segment of the flexible portion may comprise an extension with a generally spherical distal end, and a corresponding spherical recess may be disposed in the upper segment. Bearing balls adapted to transfer torque may be retained in recesses and/or grooves in the spherical portions of the upper and lower segments. In another embodiment, the flexible portion may comprise one or more universal joints. The flexible portion may comprise a compliant segment. The flexible portion may comprise a joint with laterally sliding surfaces.

The indenting member may be rotatable with respect to the bit body. A shaft may be disposed internal to the bit body and intermediate the indenting member and a rotating element such as a fluid-driven turbine, mud motor, or an electric motor. The shaft may be flexible, and may comprise a compliant portion, one or more universal joints, or a constant velocity joint.

The indenting member may comprise asymmetrical geometry on a distal end and a polycrystalline diamond cutting element. The polycrystalline diamond cutting element may comprise a pointed geometry.

The drilling assembly may comprise a mechanism adapted to selectively prevent movement of the flexible portion for drilling straight wellbores. The mechanism may be adapted to selectively limit angular deflection of the flexible portion, and may self-align the flexible portion to a position of zero angular deflection.

The drilling assembly may comprise a wiper seal disposed intermediate moveable sections of the flexible portion. The drilling assembly may also comprise a bellows-type seal disposed exterior to the flexible portion.

DETAILED DESCRIPTION OF THE INVENTION AND THE PREFERRED EMBODIMENT

Figure 1A:
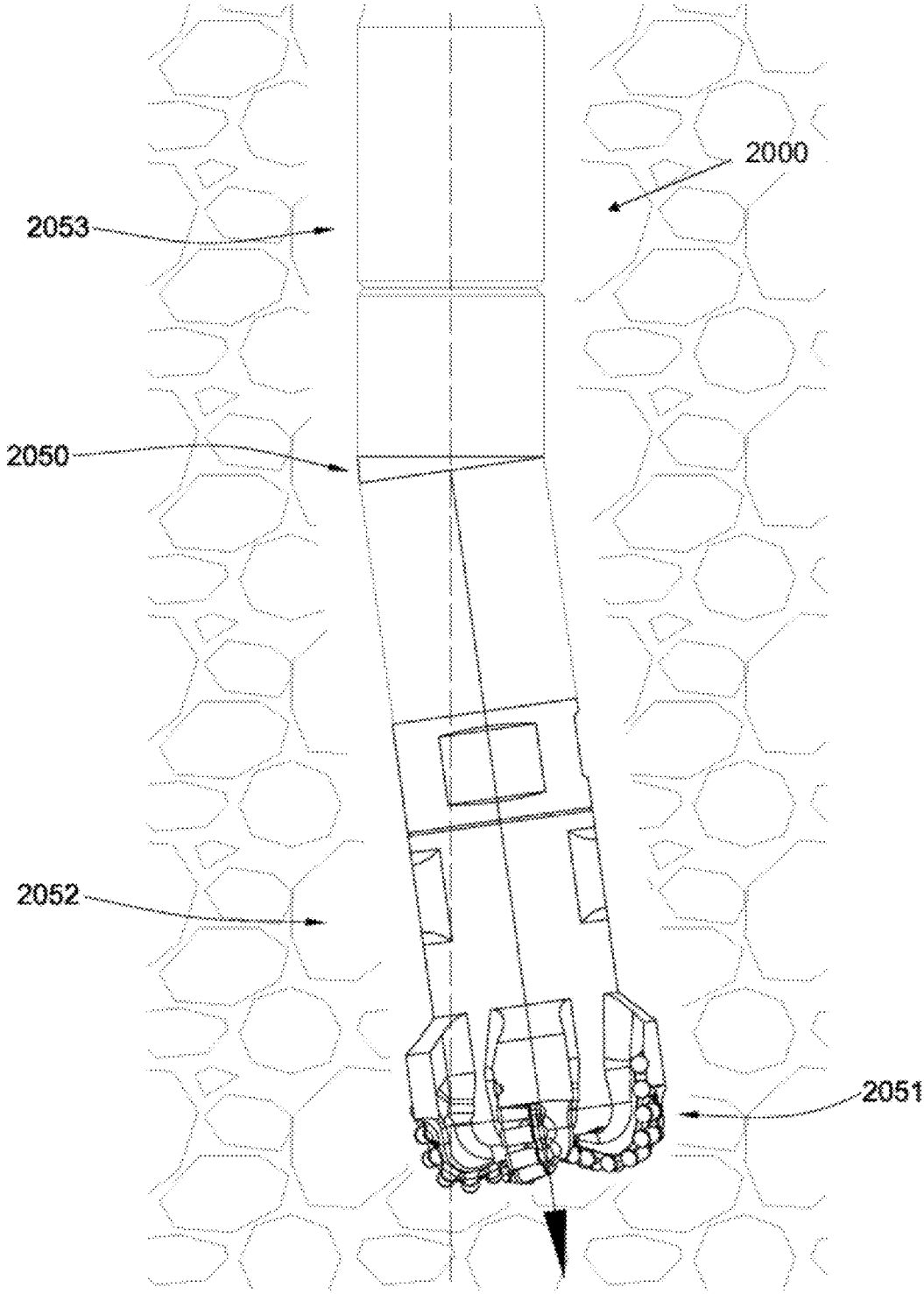
Fig. 1a PRIOR ART
FIG. 1*a* is a cross-sectional view of an embodiment of the prior art.
Figure 1B:
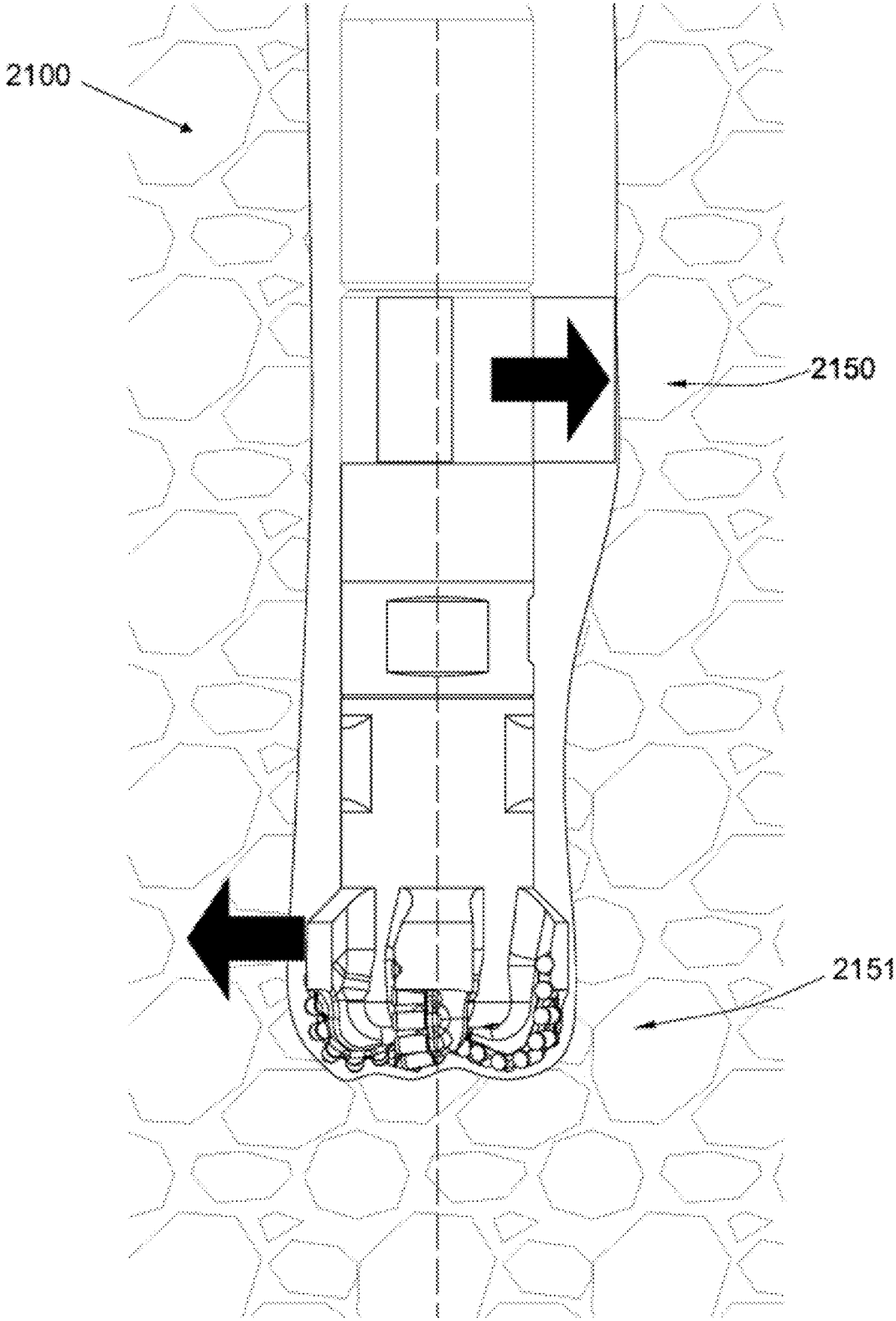
Fig. 1b PRIOR ART
FIG. 1*b* is a cross-sectional view of another embodiment of the prior art.
Figure 1C:
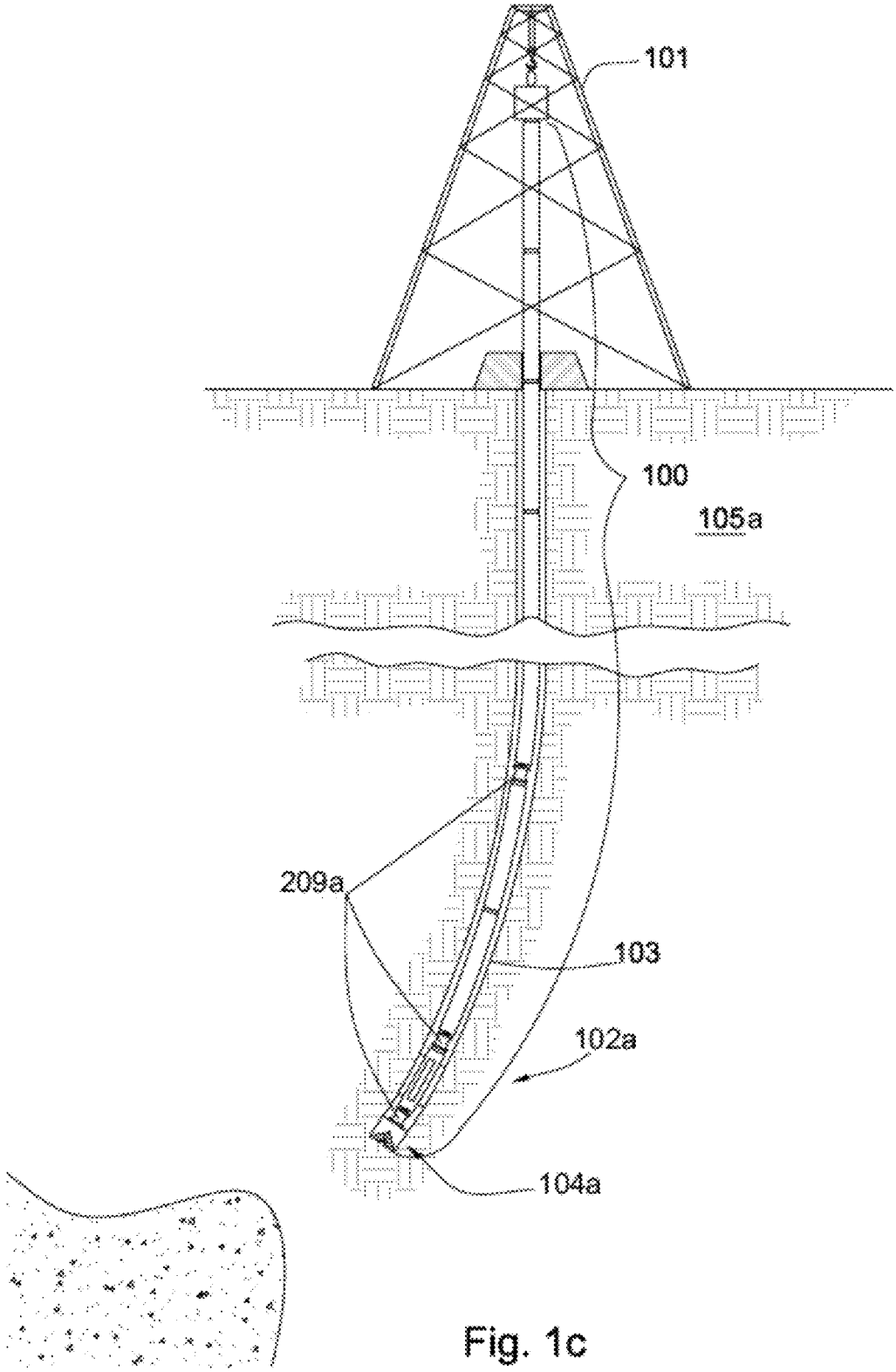
FIG. 1*c* is a cross-sectional view of an embodiment of a drill string suspended in a borehole.

FIG. 1*c* discloses a drill string 100 suspended in a borehole 103 by a derrick 101. A drilling assembly 102*a* is connected to the end of the drill string 100 and comprises a drill bit 104*a*. As the drill bit 104*a* rotates the drill string 100 advances in the formation 105*a*. The drill string 100 may comprise one or more flexible portions 209*a* to allow directional drilling.

Figure 2:
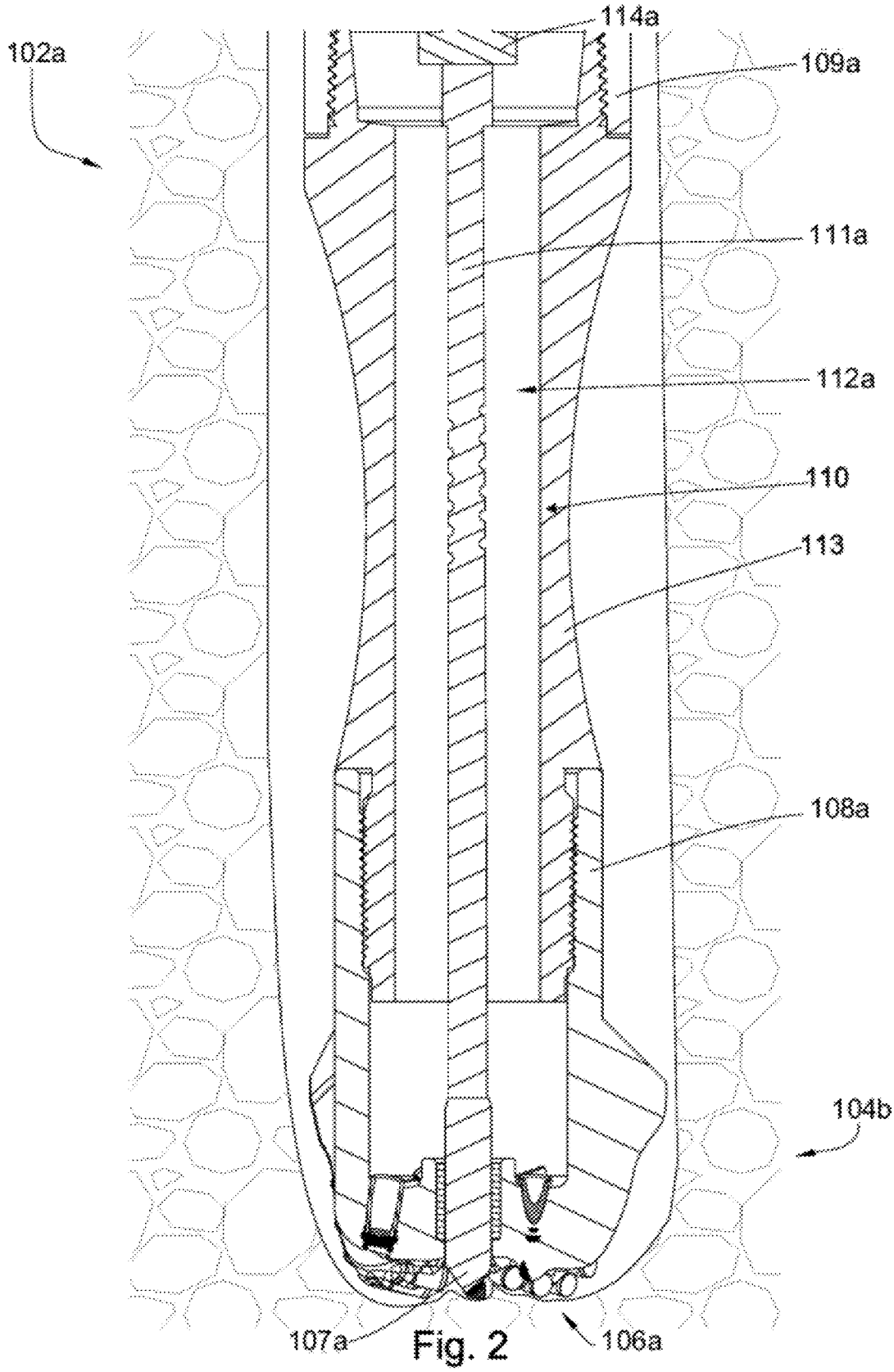
FIG. 2 is a cross-sectional view of an embodiment of a drilling assembly.

FIG. 2 discloses an embodiment of a drilling assembly 102*b*. The drilling assembly 102*b* may comprise a drill bit 104*b* with a working face 106*a*, an indenting member 107*a* protruding from the working face 106*a*, and a shank 108*a*. A compliant segment 113 may be disposed intermediate, or between, the shank 108 and a portion of the drill string 109*a*. The compliant segment 113 may comprise a portion of reduced cross-section 110 to provide elastic angular deflection with respect to an axial centerline of the portion of the drill string 109*a*. Cross-sectional area may be reduced by a taper, a series of circumferential or axial grooves, or one or more helical grooves or via a more elastic material. The compliant segment 113 may be constructed from any material with sufficient strength and suitable elastic modulus, such as high-strength steel or other metal or metal alloy. The drilling assembly 102*b* may comprise a shaft 111*a* intermediate, or between, the indenting member 107*a* and a rotating element 114*a* such as a fluid powered turbine, mud motor or an electric motor. The shaft 111*a* may comprise a compliant portion 112*a* to allow deflection in the shaft 111*a* corresponding to the deflection in the compliant segment 113.

The indenting member 107*a* may be asymmetric such that as it indents into the formation it leads the drill bit 104*b* away from a straight trajectory. The rotating element 114*a* above may be used to position an apex of the indenting member 107*a* at a desired azimuth for the drill string 109*a* to follow. In such a manner, the driller may control the trajectory of the drill string 109*a*. In some embodiments, it may be desirable for the drill string 109*a* to drill in a straight trajectory; in such cases, the indenting member 107*a* may be randomly or otherwise rotated such that it leads the drill bit 104*b* in a straight direction.

The ability of the indenting member 107*a* to steer depends on the ability of the asymmetric indenting member 107*a* to push off of the formation. In soft formations, the formation may push back on the indenting member 107*a* less. Thus, the compliant portion 112*a* may lower the amount of formation side push back on the indenting member 107*a* required to alter the path of the drill bit 104*b*.

Figure 3:
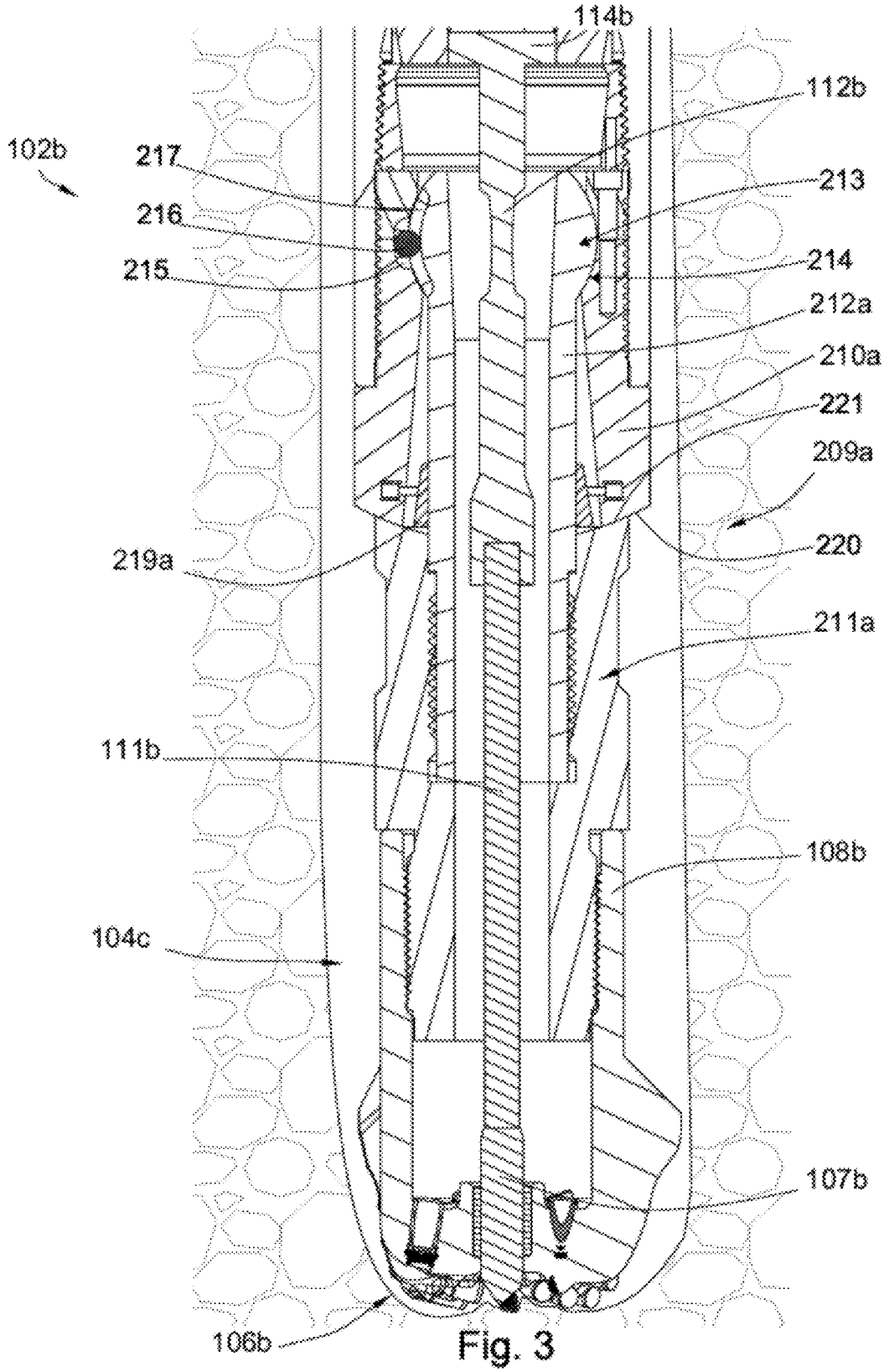
FIG. 3 is a cross-sectional view of another embodiment of a drilling assembly.

FIG. 3 discloses a drilling assembly 102*b* according to the present invention. The drilling assembly 102*b* may comprise a drill bit 104*c* with a working face 106*b*, an indenting member 107*b* protruding from the working face 106*b*, and a shank 108*b*. The shank 108*b* is connected to a flexible portion 209*a*. The flexible portion 209*a* comprises an upper segment 210*a* and a lower segment 211*a*, the lower segment 211*a* comprising an extension 212*a* with a generally spherical portion 213.

The upper segment 210*a* comprises a generally spherical recess 214 corresponding to the generally spherical portion 213 of the lower segment 211*a*. The generally spherical portion 213 is moveably retained in the generally spherical recess 214. The generally spherical recess 214 comprises a plurality of reliefs 215 which hold a plurality of bearing balls 216. The generally spherical portion 213 of the lower segment 211*a* comprises a plurality of grooves 217, the bearing balls 216 extending into the grooves 217. The bearing balls 216 are free to slide or rotate in the grooves 217 and reliefs 215, thus allowing angular deflection of the lower segment 211*a* with respect to the upper segment 210*a*, while providing torque transmission through the flexible portion 209*a* as the drilling assembly 102*b* rotates. The bearing balls 216 may be retained in a bearing cage. The bearing balls 216 may be constructed from high strength steel and may be case hardened, heat treated, or otherwise processed to provide sufficient strength. Other suitable materials such as other metals, metal alloys, or ceramic may be used. The reliefs 215 and grooves 217 that retain the bearing balls 216 may also be heat treated, case hardened, or otherwise processed to mitigate abrasive wear.

The upper segment 210*a* may comprise a mechanism that selectively prevents movement of the lower segment 211*a* with respect to the upper segment 210*a*. In this embodiment, a plurality of stops 219*a* are disposed inside the upper segment 210*a* and may be brought into contact with the lower segment 211*a*, thus preventing angular deflection of the flexible portion 209*a* and allowing the drilling assembly 102*b* to drill a straight borehole. The plurality of stops 219*a* may be actuated by a mechanical, hydraulic, or electronic system or combinations thereof.

The upper segment 210*a* of the flexible portion 209*a* comprises a face 220 with a convex, generally spherical geometry, and the lower segment 211*a* comprises a face 221 with a concave, generally spherical geometry. The faces 220, 221 on the upper segment 210*a* and the lower segment 211*a*, respectively, have a common, substantially constant radius of curvature, with a center of curvature in the same location as a center of curvature of the generally spherical portion 213 and the generally spherical recess 214. The faces 220 and 221 are in slideable contact, thus allowing angular deflection of the lower segment 211*a* with respect to the upper segment 210*a*. The faces 220 and 221 may be heat treated, case hardened, or coated with a wear resistant material such as polycrystalline diamond, a low-friction material such as PTFE, or other wear resistant and/or low friction coating.

The drilling assembly 102*b* may also comprise a shaft 111*b* intermediate, or between, the indenting member 107*b* and a rotating element 114*b*, such as a fluid-powered turbine or electric motor. The shaft 111*b* may comprise a compliant portion 112*b* to allow deflection corresponding to the deflection of the flexible portion 209*a*.

Figure 4:
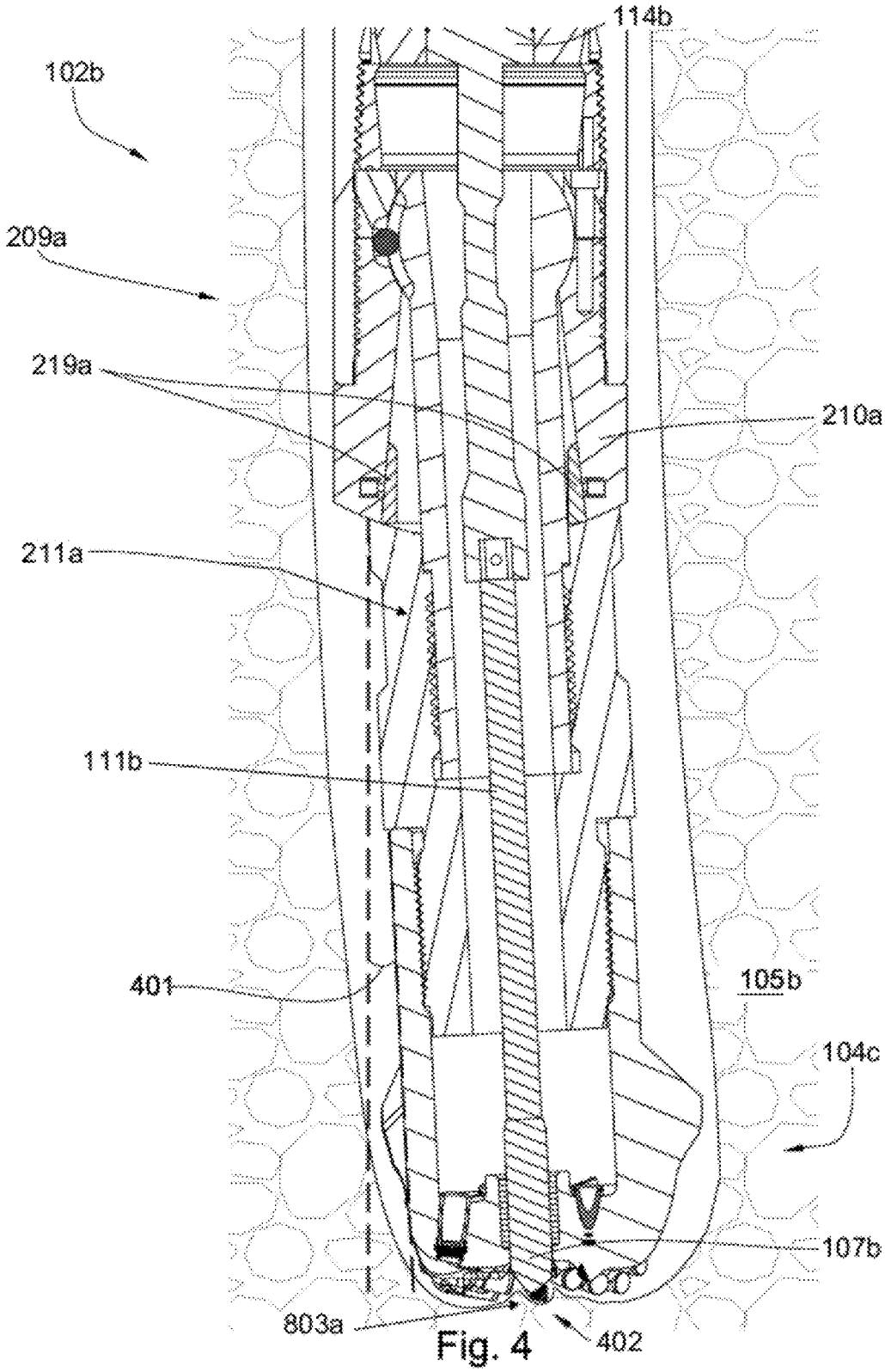
FIG. 4 is a different cross-sectional view of the embodiment of a drilling assembly in FIG. 3.

Referring now to FIG. 4, the plurality of stops 219*a* are removed from contact with the lower segment 211*a*, thus allowing greater angular deflection 401 of the lower segment 211*a* with respect to the upper segment 210*a*. The indenting member 107*b* may comprise an asymmetrical geometry 402 on a distal end 803*a*. As the drilling assembly 102*b* rotates, the rotating element 114*b* rotates the shaft 111*b* with an angular velocity having the same magnitude but opposite direction of the angular velocity of the drilling assembly 102*b*. Thus, the indenting member 107*b* has zero angular velocity with respect to the formation 105*b*, and the asymmetrical geometry 402 on the distal end 803*a* guides the drill bit 104*c* through the formation 105*b* in an azimuth direction determined by the orientation of the indenting member 107*b*.

In some embodiments the flexible portion 209*a* is moved passively in consequence of the deflections caused by the indenting member 107*b*.

The plurality of stops 219 may selectively constrain the angular deflection 401 of the flexible portion 209*a* to any angle in an interval including zero angle, or non-deviated drilling, to the maximum angle attainable by the flexible portion 209*a*.

Figure 5:
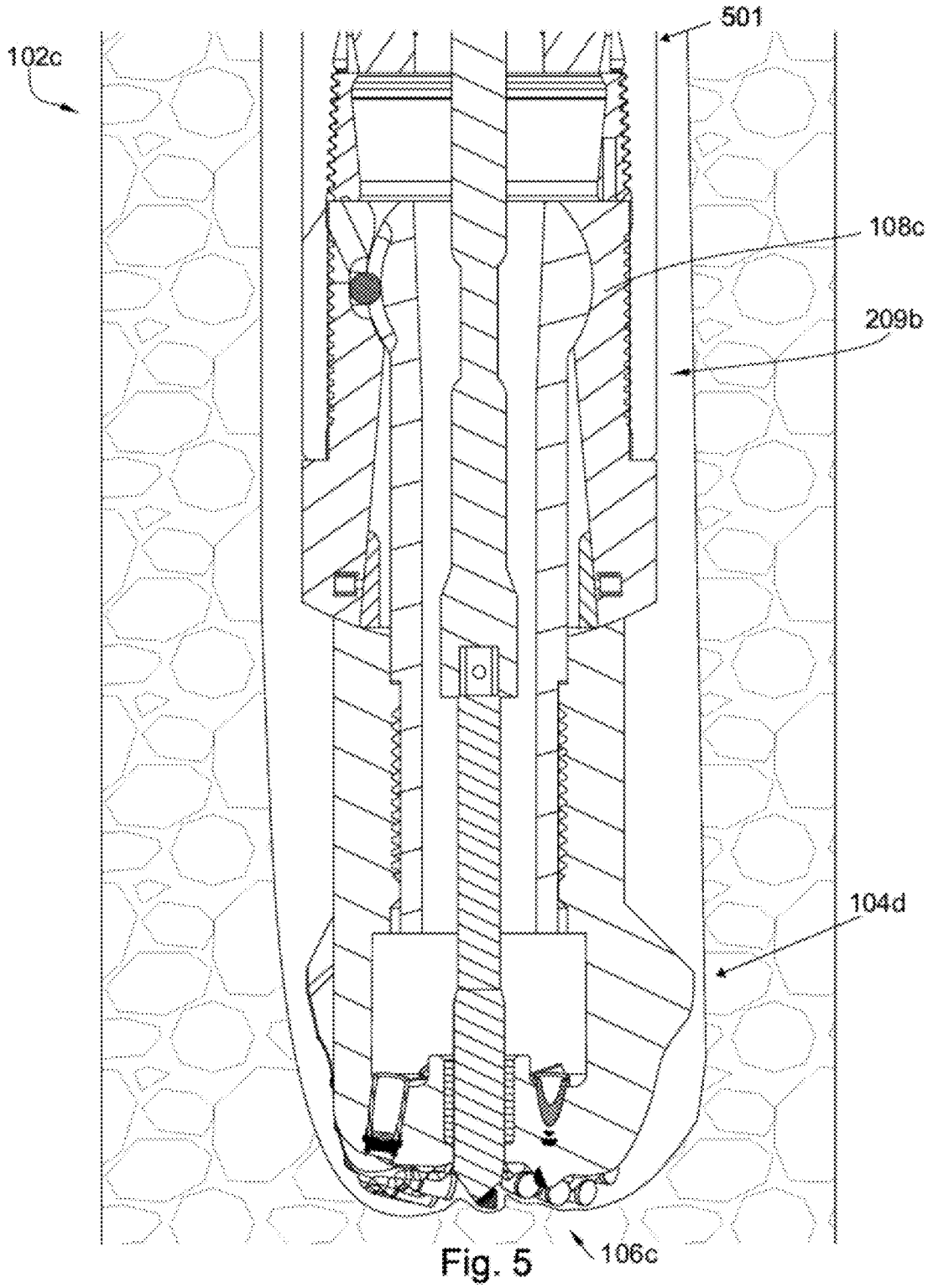
FIG. 5 is a cross-sectional view of another embodiment of a drilling assembly.

FIG. 5 discloses another embodiment of a drilling assembly 102*c* according to the present invention. In this embodiment, the drilling assembly 102*c* comprises a drill bit 104*d* comprising a working face 106*c* and a shank 108*c*. A flexible portion 209*b* is disposed intermediate, or between, the working face 106*c* and the shank 108*c*. The shank 108*c* is connected to a drill string 501.

Figure 6:
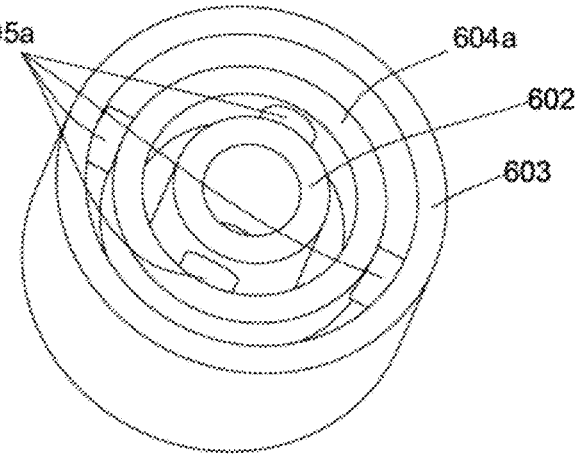
FIG. 6 is a perspective view of an embodiment of a universal joint.

FIG. 6 discloses an embodiment of a universal joint 601. The universal joint 601 comprises an inner portion 602 and an outer portion 603. The inner portion 602 is attached to the outer portion 603 by a spider 604*a* comprising bearing carriers 605*a*.

Figure 7A:
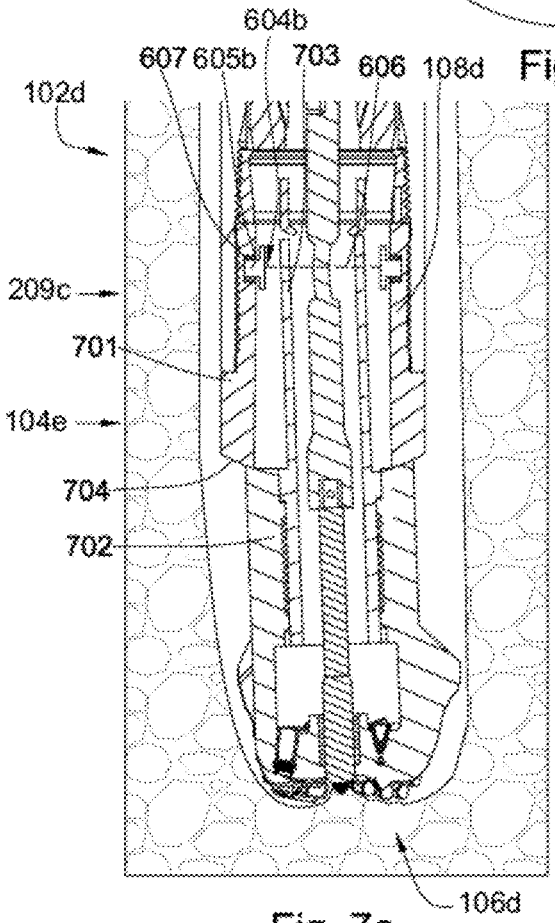
FIG. 7*a* is a cross-sectional view of another embodiment of a drilling assembly.

Referring now to FIG. 7*a*, a drilling assembly 102*d* comprises a drill bit 104*e* with a working face 106*d* and a shank 108*d*. The drill bit 104*e* comprises a flexible portion 209*c* intermediate, or between, the working face 106*d* and the shank 108*d*. The flexible portion 209*c* comprises an upper portion 701 and a lower portion 702, the lower portion 702 comprising an extension 703. A universal joint spider 604*b* comprises generally cylindrical bearing carriers 605*b* and is disposed such that an axial centerline 606 of the bearing carriers 605*b* intersects a center of curvature of a generally spherical interface 704. The bearing carriers 605*b* are held in bushings or bearings 607 in the upper portion 701 of the flexible portion 209*c*.

Figure 7B:
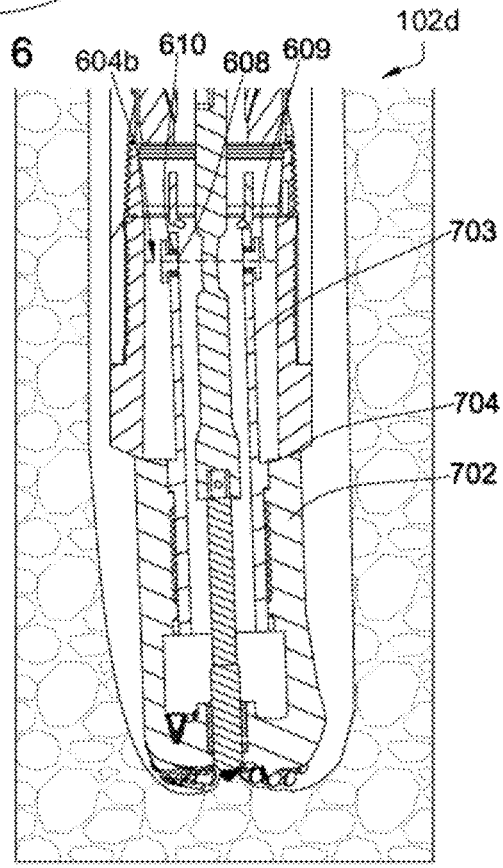
FIG. 7*b* is a different cross-sectional view of the embodiment of a drilling assembly in FIG. 7*a*.

FIG. 7*b* discloses the same embodiment as FIG. 7*a*, with the drilling assembly 102*d* rotated 90 degrees. The universal joint spider 604*b* comprises generally cylindrical bearing carriers 608, an axial centerline 609 of which intersects the center of curvature of the generally spherical interface 704. Bearing carriers 608 extend into bushings or bearings 610 disposed in the extension 703 of the lower portion 702. The bushings 607 and 610 may be made from any suitable material including bronze, steel, Babbitt metal, or a polymer.

Figure 8A:
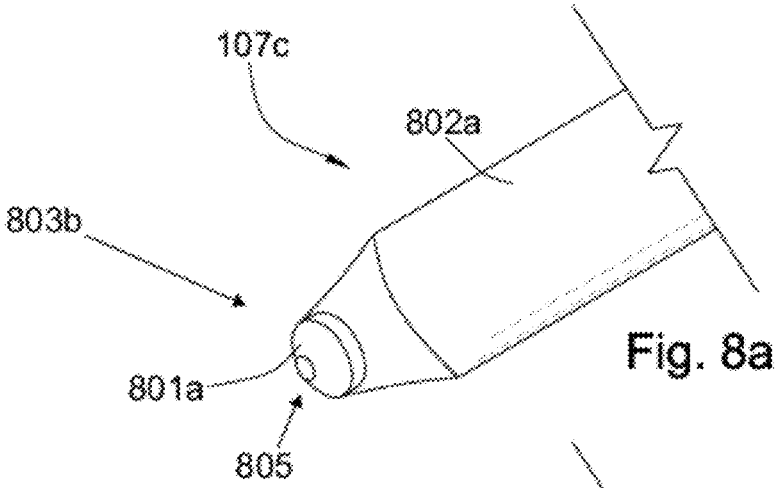
FIG. 8*a* is a perspective view of an embodiment of an indenting member.

FIG. 8*a* discloses an embodiment of an indenting member 107*c*. In this embodiment, a polycrystalline diamond compact 801*a* is brazed or otherwise affixed to a distal end 803*b* of a shank 802*a*. The polycrystalline diamond compact 801*a* may be disposed coaxial to the shank 802*a*, and the polycrystalline diamond compact 801*a* may comprise pointed geometry 805. The shank 802*a* may be constructed from a steel alloy, and may be case hardened, heat treated, or otherwise processed to improve abrasion resistance. The shank 802*a* may comprise hard-facing.

Figure 8B:
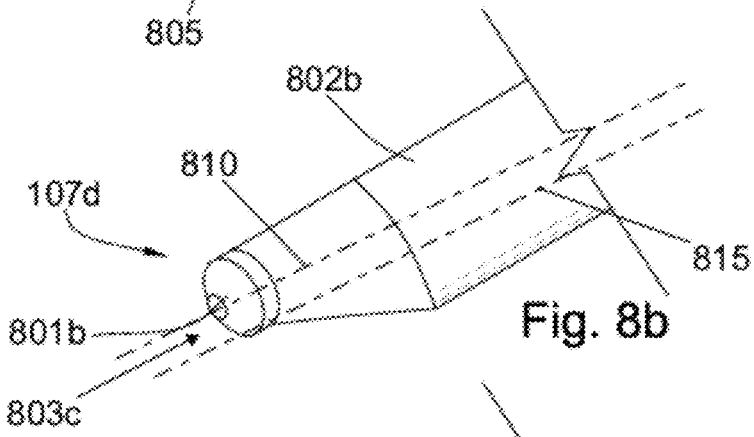
FIG. 8*b* is a perspective view of another embodiment of an indenting member.

FIG. 8*b* discloses another embodiment of an indenting member 107*d*. In this embodiment, a polycrystalline diamond compact 801*b* is brazed or otherwise affixed to a distal end 803*c* of a shank 802*b*. An axial centerline of the polycrystalline diamond compact 801*b* and an axial centerline of the shank 802*b* may be offset.

Figure 8C:
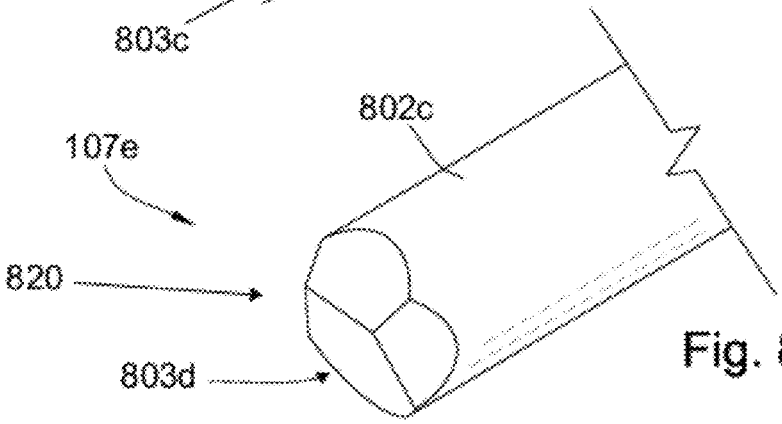
FIG. 8*c* is a perspective view of another embodiment of an indenting member.

FIG. 8*c* discloses another embodiment of an indenting member 107*e*. A shank 802*c* comprises a distal end 803*d* which may be cast, machined, forged, or otherwise formed into a generally polygonal shape 820. The generally polygonal shape 820 may be asymmetric with respect to an axial centerline of the shank 802*c*.

Figure 8D:
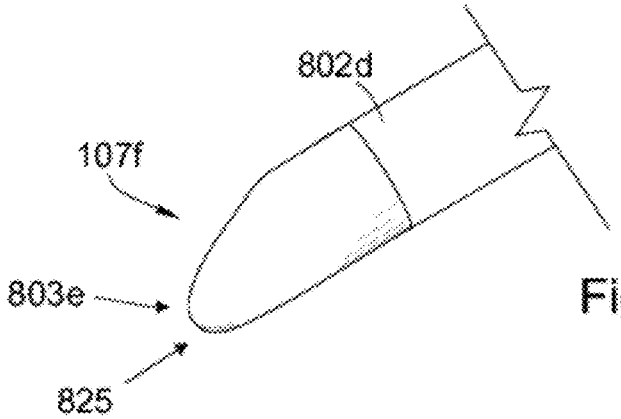
FIG. 8*d* is a perspective view of another embodiment of an indenting member.

FIG. 8*d* discloses another embodiment of an indenting member 107*f*. In this embodiment, the indenting member 107*f* comprises a shank 802*d* and a distal end 803*e*. The distal end 803*e* may comprise generally conical geometry 825, and may be asymmetric with respect to an axial centerline of the shank 802*d*. The distal end 803*e* may comprise hard-facing or other material or treatment intended to reduce abrasive wear.

Figure 9:
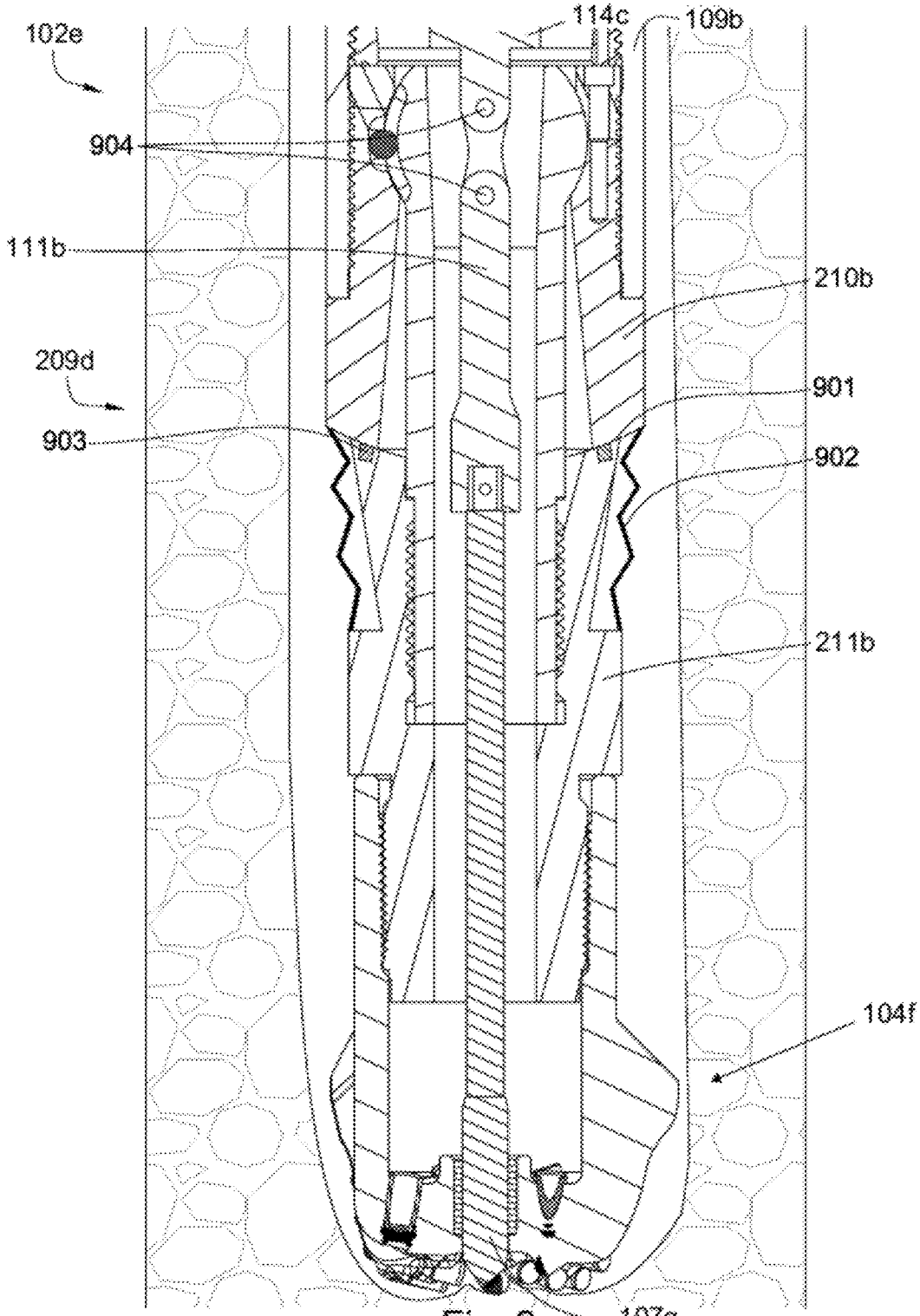
FIG. 9 is a cross-sectional view of another embodiment of a drilling assembly.

FIG. 9 discloses another embodiment of a drilling assembly 102*e* according to the present invention. Drilling assembly 102*e* comprises a flexible portion 209*d* disposed intermediate, or between, a drill bit 104*f* and a portion of drill string 109*b*. The flexible portion 209*d* comprises an interface 901 intermediate, or between, an upper segment 210*b* and a lower segment 211*b*. The interface 901 may be protected from abrasion and wear by a bellows-type cover 902. The cover 902 may be made from electron-beam welded sheet metal or another material.

The interface 901 may comprise a seal 903 disposed intermediate the upper segment 210*b* and the lower segment 211*b*. The seal 903 may comprise an o-ring or wiper seal, and may be adapted to retain lubrication on the interface 901. The interface 901 may be sealed from contact with drilling fluid or may be open to the drilling fluid.

A shaft 111*b* may be disposed intermediate an indenting member 107*g* and a rotating element 114*c*. In this embodiment, the shaft 111*b* comprises two universal joints 904 adapted to allow the shaft 111*b* to deflect according to the deflection of the flexible portion 209*d*.

Figure 10A:
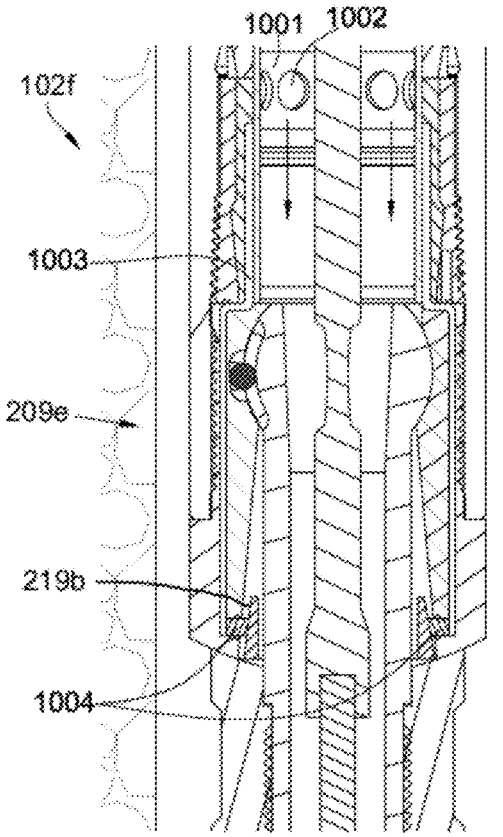
FIG. 10*a* is a cross-sectional view of another embodiment of a drilling assembly.

FIG. 10*a* discloses another embodiment of a drilling assembly 102*f*. In this embodiment, the drilling assembly 102*f* comprises a flexible portion 209*e* and includes a sliding collar 1001 comprising ports 1002. Fluid passages 1003 are in communication with a plurality of pistons 1004. The plurality of pistons 1004 are attached to mechanical stops 219*b*.

Figure 10B:
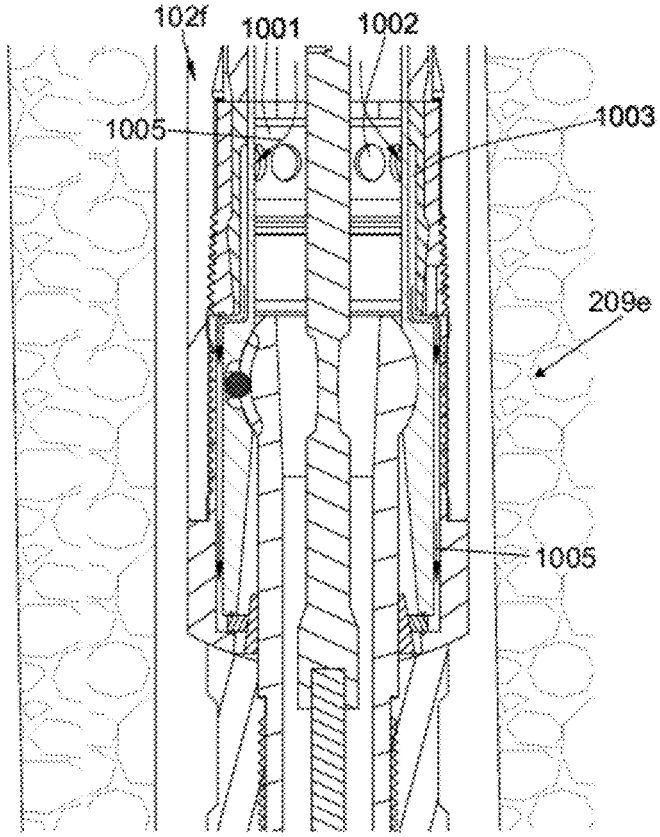
FIG. 10*b* is another cross-sectional view of the embodiment of a drilling assembly in FIG. 10*a*.

Referring now to FIG. 10*b*, the ports 1002 in the sliding collar 1001 are now in communication with a plurality of fluid passages 1003. Drilling fluid 1005 is diverted into and creates fluid pressure in passages 1003.

Figure 10C:
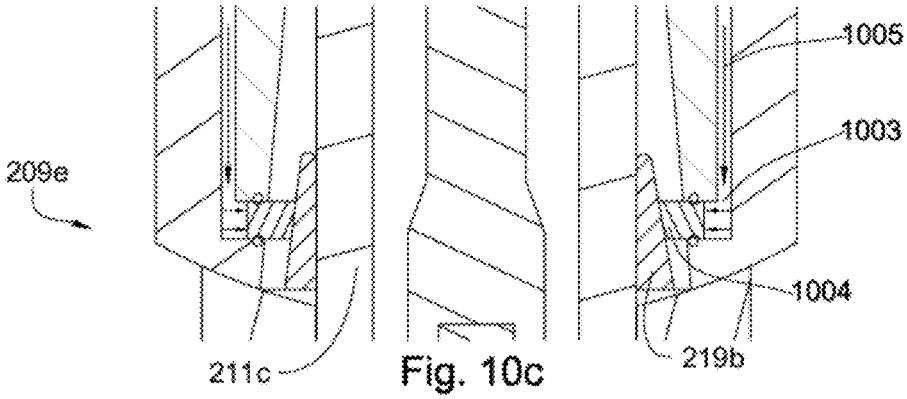
FIG. 10*c* is a detailed view of the embodiment of a drilling assembly in FIG. 10*a*.

Referring now to FIG. 10*c*, which is a detailed view of FIG. 10*b*, drilling fluid 1005 creates fluid pressure in the passages 1003 that forces the plurality of pistons 1004 and mechanical stops 219*b* inward to contact a lower segment 211*c* of the flexible portion 209*e*. Flexible portion 209*e* is thus immobilized to allow drilling of straight wellbores.

Figure 11A:
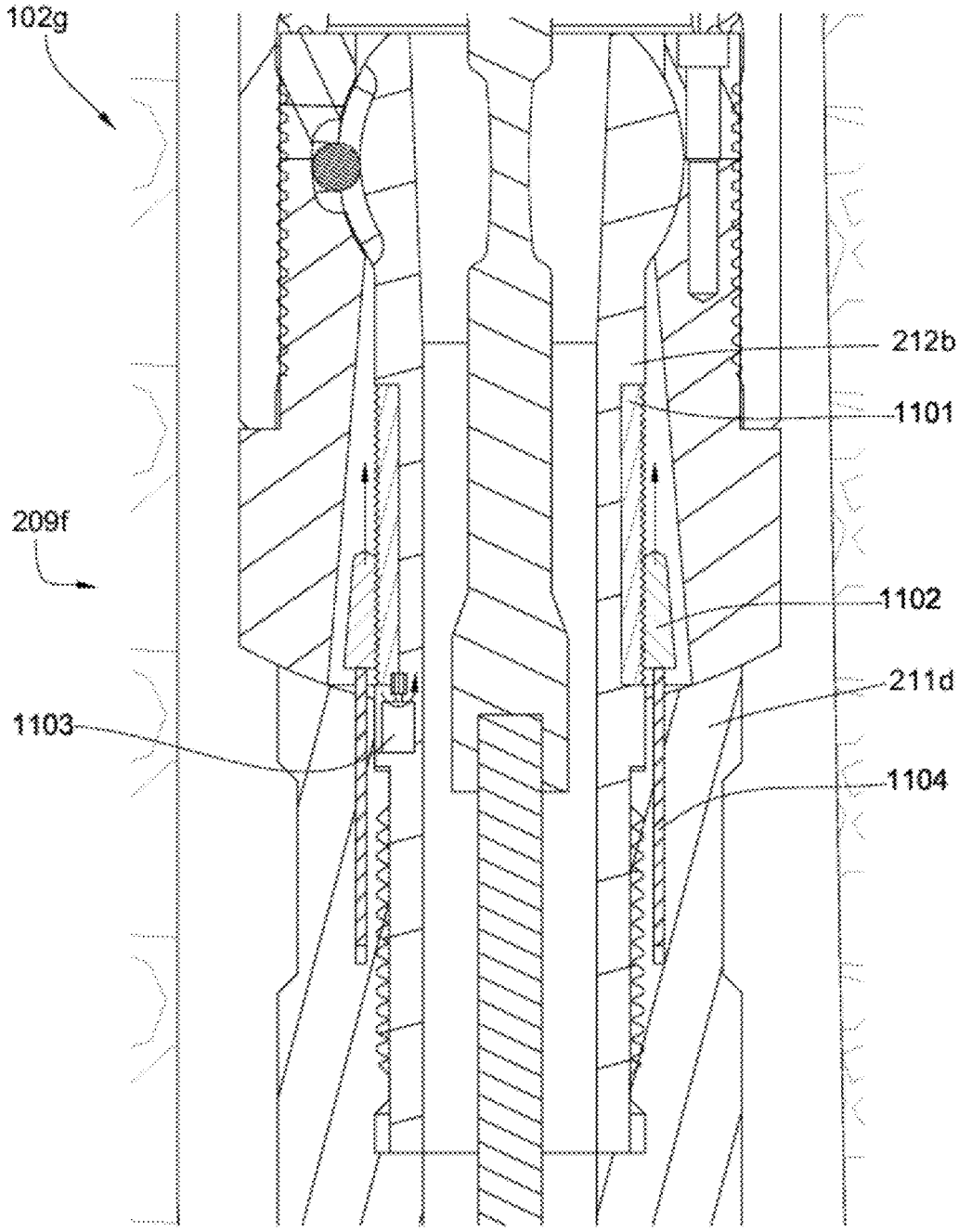
FIG. 11*a* is a cross-sectional view of another embodiment of a drilling assembly.

FIG. 11*a* discloses another embodiment of a drilling assembly 102*g*. In this embodiment, a lower segment 211*d* of a flexible portion 209*f* comprises a threaded sleeve 1101 engaged with a threaded collar 1102. The threaded sleeve 1101 is free to rotate on an extension 212*b* of a lower segment 211*d* of the flexible portion 209*f*. An electric motor 1103 rotates the threaded sleeve 1101, and alignment pins 1104 prevent the rotation of the threaded collar 1102. As the electric motor 1103 rotates the threaded sleeve 1101, the non-rotating threaded collar 1102 moves upward. Maximum angular deflection of the flexible portion 209*f* can be controlled by adjusting the position of the threaded collar 1102, and as the threaded collar 1102 moves upward it aligns the flexible portion 209*f* to a position of zero angular deflection.

Figure 11B:
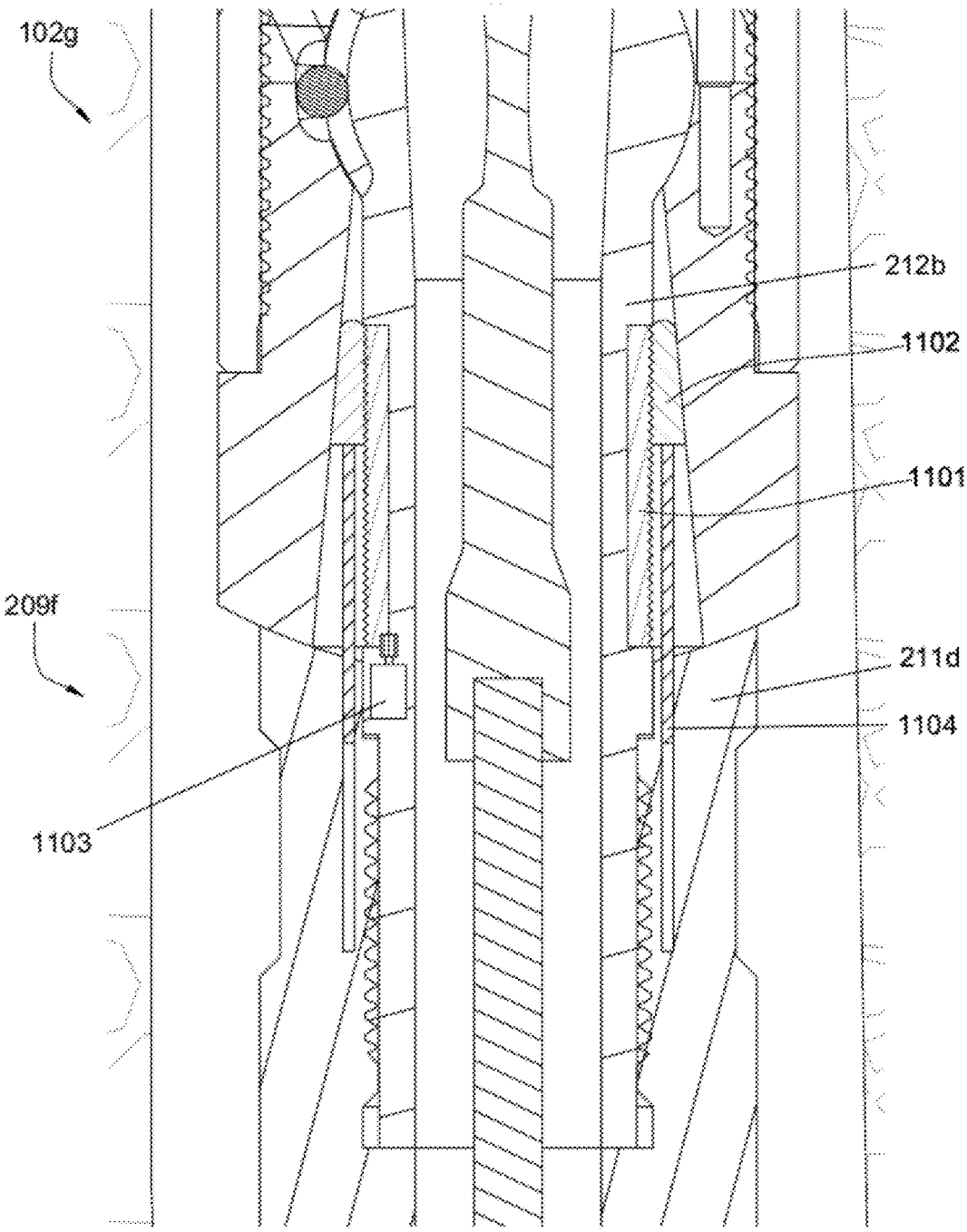
FIG. 11*b* is another cross-sectional view of the embodiment of a drilling assembly in FIG. 11*a*.

Referring now to FIG. 11*b*, the threaded collar 1102 is engaged with the rotatable threaded sleeve 1101. The threaded collar 1102 is in its maximum upward position, effectively immobilizing the flexible portion 209*f* to allow for straight drilling.

Figure 12:
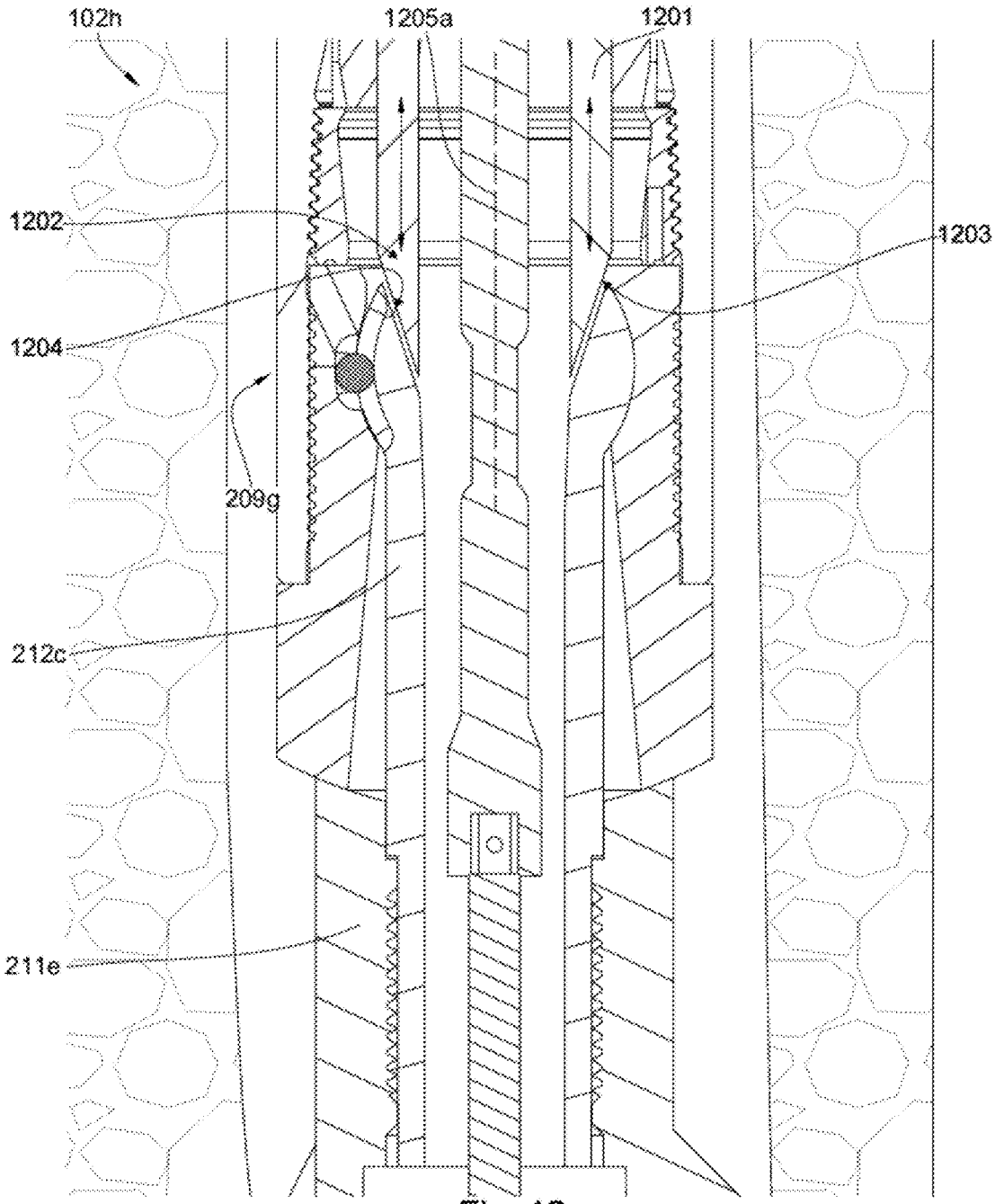
FIG. 12 is a cross-sectional view of another embodiment of a drilling assembly.

FIG. 12 discloses another embodiment of a drilling assembly 102*h*. In this embodiment, a collar 1201 comprises a distal end 1202 with a generally conical geometry 1203. A flexible portion 209*g* comprises a lower segment 211*e* with an extension 212*c*, which also comprises generally conical geometry 1204. The collar 1201 may be movable in a direction coaxial with an axial centerline 1205*a* of the drilling assembly 102*h*. The position of the collar 1201 determines the maximum angular deflection of the lower portion 211*e* of the flexible portion 209*g*. The position of the collar 1201 may be controlled by a mechanical, electronic, hydraulic, or other system, or combinations thereof. As the collar 1201 moves toward the lower portion 211*e* of the flexible portion 209*g*, the generally conical geometries 1203 and 1204 are brought into mechanical contact and the lower portion of the joint 211*e* self-aligns with the collar 1201 and the flexible portion 209*g* reaches a position of zero angular deflection.

Figure 13:
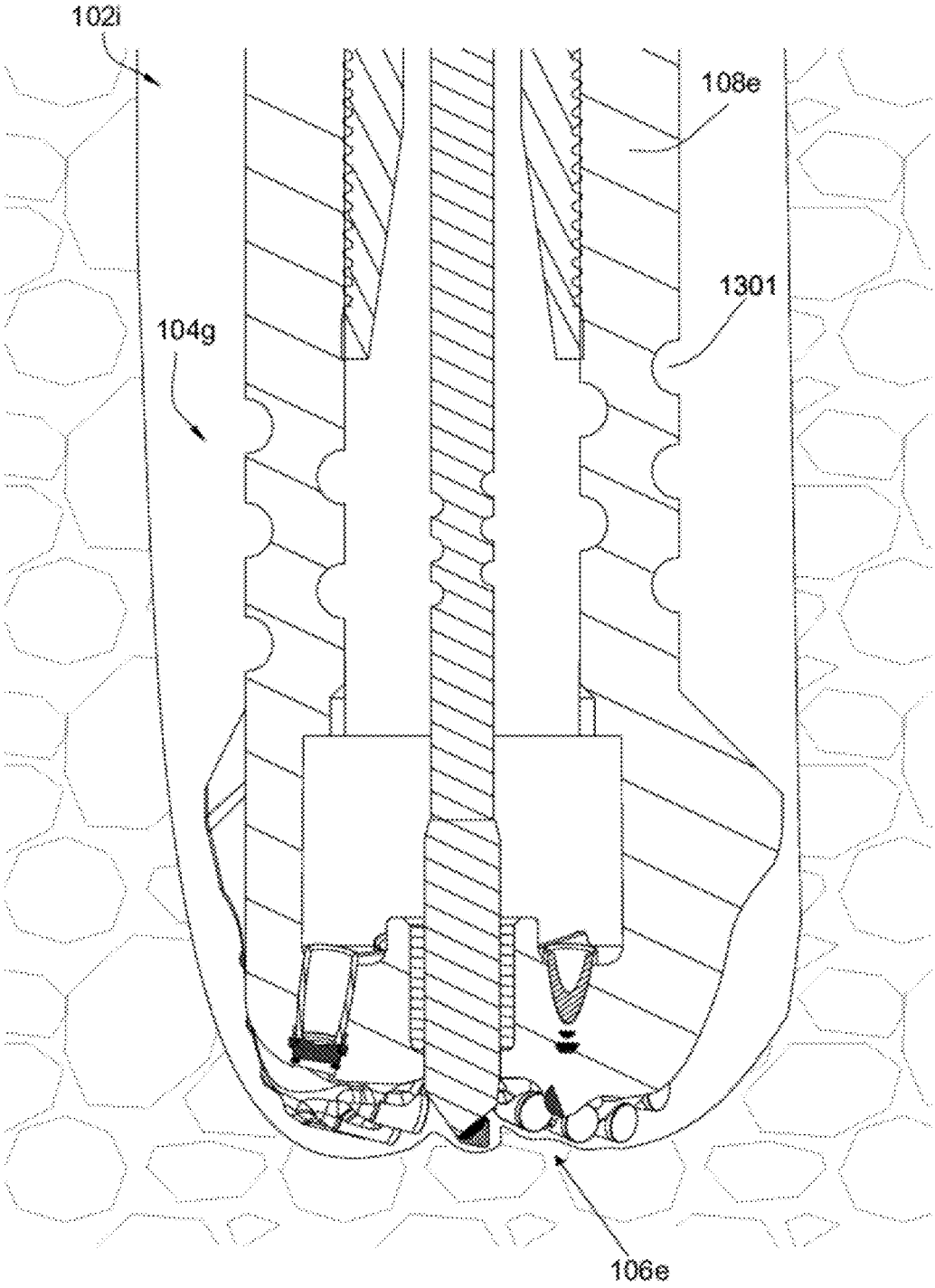
FIG. 13 is a cross-sectional view of another embodiment of a drilling assembly.

FIG. 13 discloses another embodiment of a drilling assembly 102*i*. A drill bit 104*g* comprises a plurality of grooves 1301 intermediate, or between, a working face 106*e* and a shank 108*e*. The grooves 1301 may be circumferential, helical, or otherwise oriented and may be machined, forged, cast, or otherwise formed in the drill bit 104*g*. The grooves 1301 allow for elastic, angular deflections in the drill bit 104*g*.

Figure 14:
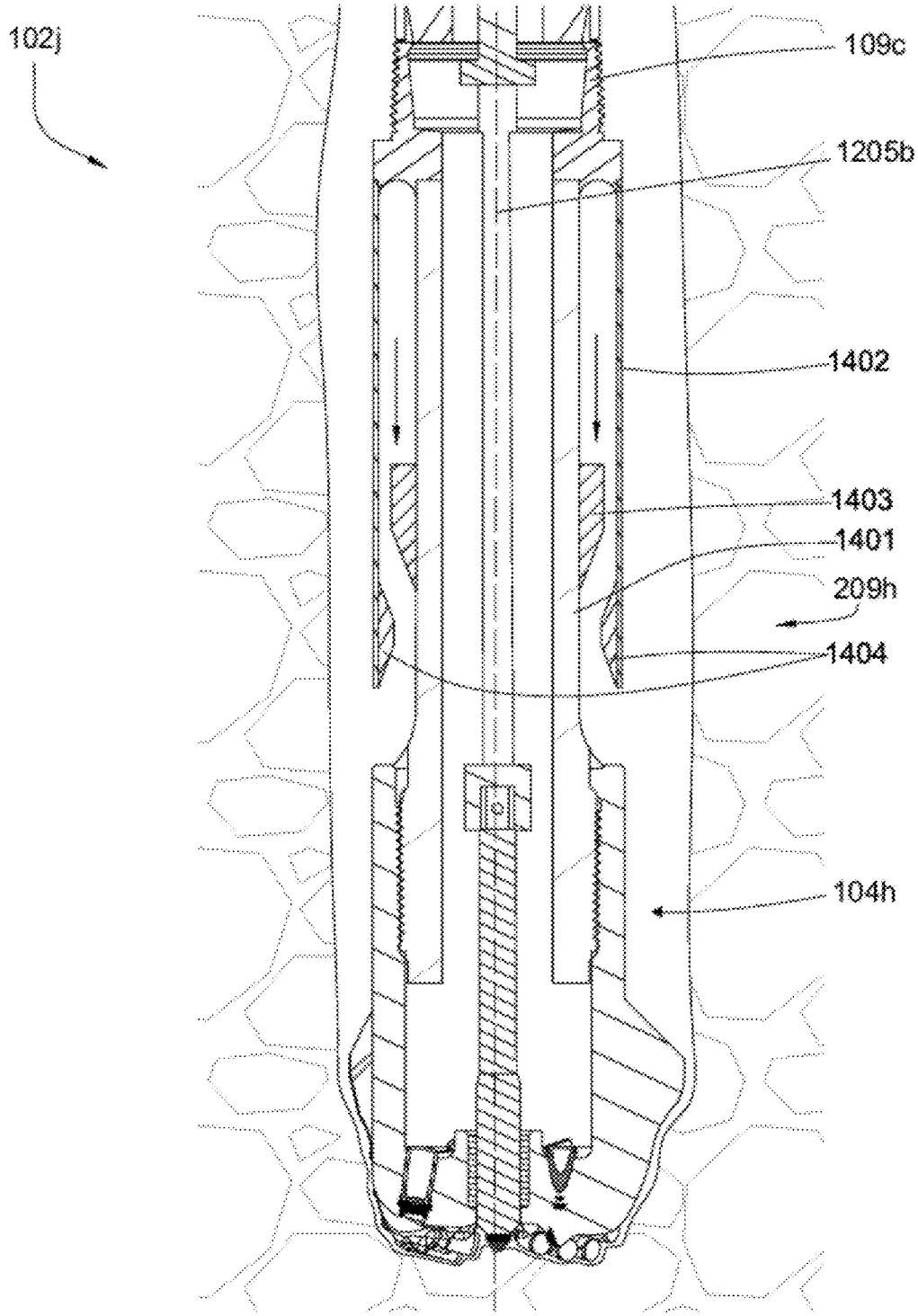
FIG. 14 is a cross-sectional view of another embodiment of a drilling assembly.

FIG. 14 discloses another embodiment of a drilling assembly 102*j*. A flexible portion 209*h* is disposed intermediate, or between, a drill bit 104*h* and a portion of a drill string 109*c*. The flexible portion 209*h* comprises a compliant segment 1401 and an outer sleeve 1402. A collar 1403 is moveable in a direction coaxial to an axial centerline 1205*b* of the drilling assembly 102*j*. Mechanical stops 1404 are disposed internal to the outer sleeve 1402. The collar 1403 may selectively be brought into mechanical contact with the stops 1401, thus limiting or disallowing angular deflection of the compliant segment 1401 and the drill bit 104*h*.

Figure 15:
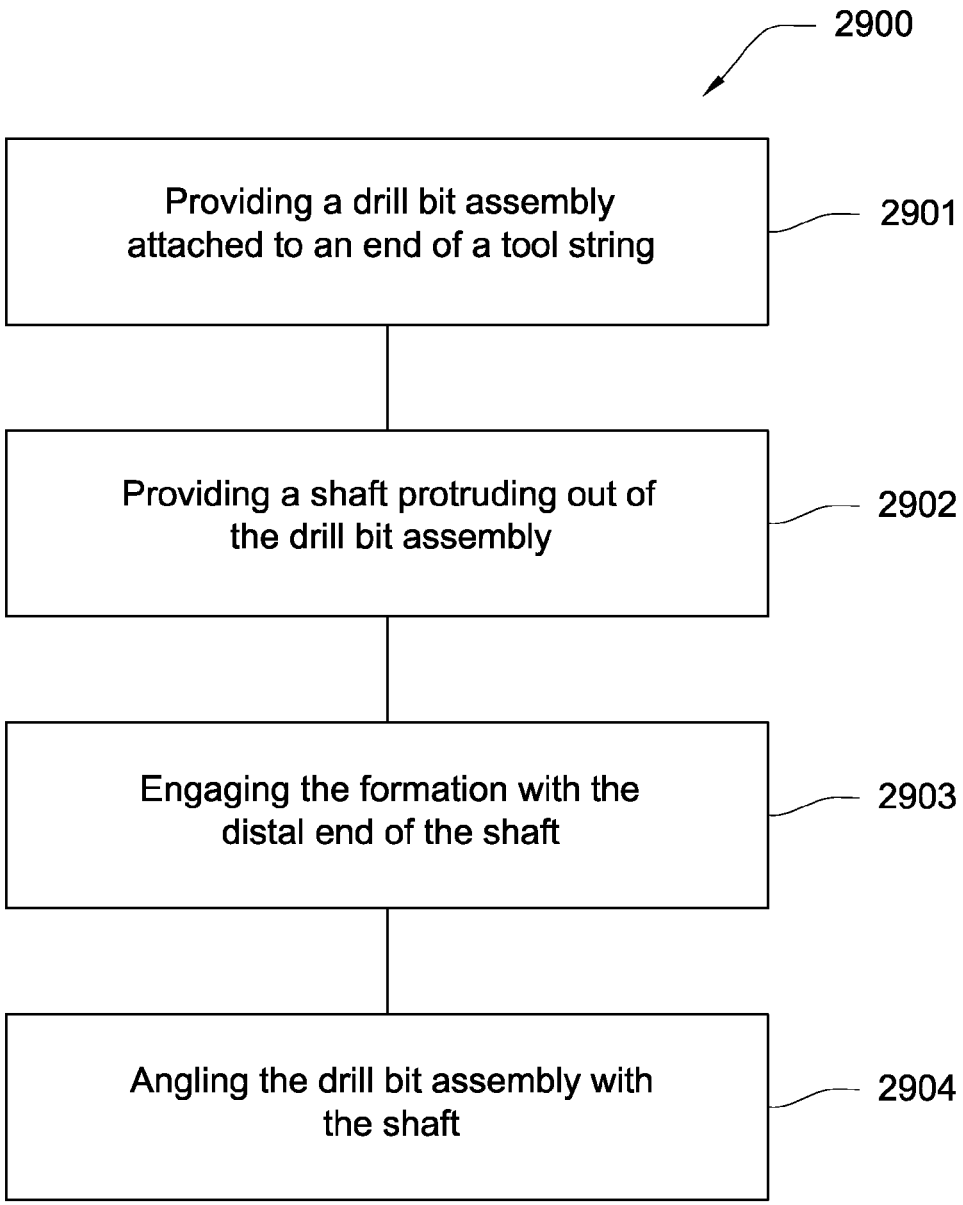
FIG. 15 is a diagram of an embodiment of a steering method.

FIG. 15 is a diagram of a method 2900 for steering a downhole tool string. The method comprises the steps of providing 2901*a* drill bit assembly attached to an end of the tool string disposed within a bore hole; providing 2902 a shaft protruding from a working portion of the drill bit assembly, the working portion comprising at least one cutting element; engaging 2903 the formation with a distal end of the shaft, the shaft being part of the drill bit assembly; and angling 2904 the drill bit assembly with the shaft along a desired trajectory. The step of angling 2904 the drill bit assembly with the shaft may comprise angling the shaft or the step may include pushing the drill bit assembly along the desired trajectory with the shaft. It is believed that if the shaft is loaded with enough pressure that the shaft will penetrate the formation, but if the shaft does not overcome the formation pressure, then the shaft may move the drill bit assembly by pushing off of the formation. A narrow distal end may aid in concentrating the pressure loaded to the shaft into the formation such that it may overcome the formation pressure and penetrate the formation; on the other hand, a blunt or wide distal end may prevent the shaft from penetrating the formation and allow the shaft to push off of the formation. In some embodiments, the shaft may advance along the desired trajectory before the drill bit assembly. The shaft may be at least partially disposed within a chamber generally coaxial with the shank portion of the assembly and the chamber may be disposed within a body portion of the assembly. Angling 2904 the drill bit assembly may be controlled over a downhole network.

In some embodiments, the shaft is rotationally isolated from the working portion of the drill bit assembly. This may be advantageous because it allows the shaft to remain on the desired trajectory even though the remainder of the drill bit assembly is rotating. In some embodiments of the method, the shaft may also rotate with the body portion of the drill bit assembly if there is a plurality of actuators timed to temporally move the shaft such that the distal end of the shaft stays on the desired trajectory.

Whereas the present invention has been described in particular relation to the drawings attached hereto, it should be understood that other and further modifications apart from those shown or suggested herein, may be made within the scope and spirit of the present invention.

What is claimed is:

1. A method for steering a downhole tool string through a formation, comprising:

positioning a drill bit adjacent a drill string component, the drill bit including:

a working face;

a shank;

a bit body between the working face and the shank;

an indenting member having a distal end protruding from the working face;

a flexible portion disposed above the bit body between the shank and the adjacent drill string component, the flexible portion including an upper segment and a lower segment; and, at least one of an o-ring disposed between the upper segment and the bit body, a wiper seal disposed between the upper segment and the bit body, and a bellows-type seal disposed exterior to the flexible portion;

positioning the drill string component and the drill bit in a bore hole; and, orienting the indenting member in a desired trajectory.

2. The method of claim 1, further comprising rotating at least one of the drill string component and the drill bit.

3. The method of claim 1, further comprising rotating the drill bit in a direction and rotating the indenting member in another direction opposite the direction that the drill bit rotates.

4. The method of claim 1, further comprising pushing the indenting member against the formation.

5. The method of claim 1, wherein orienting the indenting member in a desired trajectory further comprises at least one of orienting the indenting member in a desired azimuth and angling the distal end of the indenting member.

6. A method for steering a downhole tool string through a formation, comprising:

positioning a drill bit in a bore hole, the drill bit including:

a working face;

a shank;

a bit body between the working face and the shank;

an indenting member having a distal end protruding from the working face; and, a flexible portion disposed above the bit body, the flexible portion including:

a lower segment that includes an extension with a generally spherical geometry on a distal end; and, an upper segment that includes a generally spherical recess that corresponds with the generally spherical geometry of the lower segment; and, positioning the indenting member in a desired trajectory.

7. The method of claim 6, further comprising rotating the drill bit in a direction and rotating the indenting member in another direction opposite the direction that the drill bit rotates.

8. The method of claim 6, further comprising pushing the indenting member against the formation.

9. The method of claim 6, wherein positioning the indenting member in a desired trajectory further comprises at least one of orienting the indenting member in a desired trajectory, orienting the indenting member in a desired azimuth, and angling the distal end of the indenting member.

10. A method for steering a downhole tool string through a formation, comprising:

positioning a fluid-driven turbine and a drill bit in a bore hole, the drill bit including:

a working face;

a shank;

a bit body between the working face and the shank;

an indenting member having a distal end protruding from the working face; and, a flexible portion disposed above the bit body, the flexible portion including:

a lower segment;

an upper segment; and an interface between the lower and upper segment, the interface including at least one of an o-ring and a wiper seal to create a seal; and, positioning the indenting member in a desired trajectory.

11. The method of claim 10, further comprising rotating the drill bit in a direction and rotating the indenting member in another direction opposite the direction that the drill bit rotates.

12. The method of claim 10, further comprising pushing the indenting member against the formation.

13. The method of claim 10, wherein positioning the indenting member in a desired trajectory further comprises at least one of orienting the indenting member in a desired trajectory, orienting the indenting member in a desired azimuth, and angling the distal end of the indenting member.

14. A method for steering a downhole tool string through a formation, comprising:

positioning a drill bit in a bore hole, the drill bit including:

a working face;

a shank;

a bit body between the working face and the shank;

an indenting member having a distal end protruding from the working face; and, a flexible portion disposed above the bit body, the flexible portion including:

a lower segment;

an upper segment; and, an interface between the lower and the upper segment; and, a bellows-type cover disposed exterior to the flexible portion; and, positioning the indenting member in a desired trajectory.

15. The method of claim 14, further comprising rotating the drill bit in a direction and rotating the indenting member in another direction opposite the direction that the drill bit rotates.

16. The method of claim 14, further comprising pushing the indenting member against the formation.

17. The method of claim 14, wherein positioning the indenting member in a desired trajectory further comprises at least one of orienting the indenting member in a desired trajectory, orienting the indenting member in a desired azimuth, and angling the distal end of the indenting member.

* * * * *